US007845824B2

(12) United States Patent
Robotham

(10) Patent No.: US 7,845,824 B2
(45) Date of Patent: Dec. 7, 2010

(54) VIRTUAL SINGLE LIGHT SOURCE HAVING VARIABLE COLOR TEMPERATURE WITH INTEGRAL THERMAL MANAGEMENT

(75) Inventor: Thomas Robotham, Scituate, MA (US)

(73) Assignee: Robotham Creative, Inc., Scituate, MA (US)

( * ) Notice: Subject to any disclaimer, the term of this patent is extended or adjusted under 35 U.S.C. 154(b) by 217 days.

(21) Appl. No.: 12/229,903

(22) Filed: Aug. 27, 2008

(65) Prior Publication Data

US 2009/0207604 A1 Aug. 20, 2009

Related U.S. Application Data

(60) Provisional application No. 61/124,828, filed on Feb. 19, 2008.

(51) Int. Cl.
*F21V 14/00* (2006.01)

(52) U.S. Cl. ..... 362/231; 362/230; 362/249.02

(58) Field of Classification Search ..... 362/1, 362/11, 230, 231, 249.02
See application file for complete search history.

(56) References Cited

U.S. PATENT DOCUMENTS

2009/0021587 A1* 1/2009 Snyderman et al. .... 348/207.11

* cited by examiner

*Primary Examiner*—David V Bruce
(74) *Attorney, Agent, or Firm*—Hamilton Brook Smith & Reynolds, P.C.

(57) ABSTRACT

A lamp that allows a user to adjust parameters to control emitted white light, specifically quality, intensity and color temperature. Under such control, the lamp can match, complement, or augment ambient or available natural or artificial light. In specific embodiments, the lamp uses high power, high CRI, white LED sources; integral thermal management that also functions as LED structural support; integral optics (secondary lenses) with accommodation for diffusing elements; and manually responsive controls.

26 Claims, 20 Drawing Sheets
(4 of 20 Drawing Sheet(s) Filed in Color)

VIRTUAL SINGLE LIGHT SOURCE HAVING VARIABLE COLOR TEMPERATURE WITH INTEGRAL THERMAL MANAGEMENT

RELATED APPLICATION(S)

This application claims the benefit of provisional application Ser. No. 61/124,828, filed on Feb. 19, 2008, which was converted from non-provisional U.S. application Ser. No. 12/070,505, filed on Feb. 19, 2008. The entire teachings of the above application(s) are incorporated herein by reference.

BACKGROUND

The entire contents of this document are copyright (c) 2008 Robotham Creative, Inc.; all rights reserved.

The domain of the present invention is lighting, encompassing the technical uses of lighting for photographic purposes, including motion picture, video and digital imaging. It also encompasses the areas of critical viewing, both for task and ambient light, and lighting design for commercial or residential space, as well as light for general use when the user is cognizant of lighting qualities even if not technically proficient in their measurement and control.

Introduction—People face the problem of needing to augment available ambient light with additional light sources or lamps. They may also need to create light where none exists. People with technical proficiency in lighting have strategies and means to provide this needed light in a manner that is technically and aesthetically appropriate to the situation. This includes people such as those involved in creating images through photographic means (including still and motion picture photography with film, video or digital means), or involved in lighting design, or those professionally evaluating images or materials. The added light should be sensible in terms of matching or complementing available light, or with the characteristics that would be expected if ambient or natural lighting existed. Any new source will be selected and if necessary, modified, to suit parameters such as the direction, quality, intensity and color temperature as well as color rendering of the existing or expected light. If this is not accomplished, then the work, imaging or viewing is compromised. This requires a moderate to high level of technical proficiency to enact successfully, and is often time consuming.

There is a large population without technical proficiency in lighting, but who are observant or sensitive to their lighting environment. For example: anyone who has dimmed a light or shut off a fluorescent light or lit candles to suit a mood; or who has preferred the light of daylight fluorescents at work during daytime, and their incandescent desk lamp when working late at night. More recently, this would include anyone who has turned off a Light Emitted Diode (LED) desk light at night because the light is too "cold" for night reading. There are a number of lamp types that are designed for this population to suit one particular time of day or unvarying subjective quality of light, thus requiring no particular technical proficiency to use.

The method of intentionally using and blending light sources with more than one color temperature has been in existence since the advent of color photography, and exploited for centuries before that in paintings. An example image could include a person sitting in a room with a lantern, and daylight streaming in a window. The lantern light is warmer, the daylight cooler. These sources have different color temperatures and the intermediate, blended values might be seen on the subject's face. A camera would register and record all of these varying color temperatures. The resulting image would be a type ubiquitous in modern motion pictures and still photos, with warm and cool light plus blended and neutral tones seen on the subject.

Color temperature is objectively measured in degrees Kelvin (° K.), with a color meter or through other photometric means. Film is supplied as either daylight or tungsten balance, with any variation from the two established norms compensated for by use of calibrated filtration. In video and digital imaging systems, the term "white balance" is used to refer to the system tracking of color temperature to render a white or neutral color correctly, without amber or blue bias. The human mind does this automatically, and novices are often surprised that light they perceive as neutral is recorded as deep amber or bright blue.

Pertinent technical issues of lighting are described in further detail in the attached Appendix.

Because most sources do not match the full spectral output of a "black body radiator", measurement of their output is labeled as degrees Kelvin CCT, or correlated color temperature. A single lamp with multiple bulbs (sources) of differing CCT value may exhibit a blended CCT. An example is a fluorescent luminaire designed for motion picture use that can house combinations of individual tubes with either daylight CCT or tungsten/halogen CCT values. In a lamp that houses four tubes, CCT can be adjusted in one quarter increments of intermediate values between daylight and tungsten CCT.

This concept has been demonstrated in many other lighting devices that house more than one individual source. Intermediate CCT values are obtainable by using individual sources within the lamp of differing CCT, and if these source types are dimmable (as most are) that by reciprocal dimming a range of intermediate CCT values can be obtained. This has been shown for fluorescent lighting by Ravi et al in U.S. Pat. No. 5,952,343 from 1998, wherein two fluorescent lights of differing CCT, within the same housing, are provided with varying power to vary the blended total CCT output of the device. It has also been shown with MR16 halogen sources using warm and cool CCT bulbs (commercially available employing dichroic filtration) arranged in an array and separately dimmed according to CCT value.

There is an existing technology to provide a light source with user variable CCT through an entirely different approach. According to the teachings of You, et al. in U.S. Pat. No. 7,201,494, this involves using LEDs with narrow spectral output, which combined in Red, Green and Blue arrays can be tightly controlled to produce white light with sufficiently predictable CCT and high CRI for use in these critical viewing or photographic applications. There are a number of inventions with similar approach, differing in details of use, components, construction or application. These inventions and products involve blending of single wavelength output LED light, whether just RGB primaries or including secondary colors such as cyan, magenta and yellow, rather than blending full spectrum white LED light of differing CCT values.

This type of RGB blending, or RGB plus secondaries blending, is consistent in conceptual approach with that of computer and video monitors, which create colors and white through mixture. The tracking of white light values through this approach is illustrated through the CIE chromaticity chart with blackbody locus (see FIG. 4). When control over white light is the desired function, only an extremely small subset of the total gamut is of concern, that of the blackbody locus and its immediate surroundings. When RGB blending is used to track these specific coordinates, the vast majority of total available gamut is ignored, and if that gamut is exploited, it is outside the area of concern for white lighting. Maintaining white light output with RGB blending involves high precision sensors and feedback loops to arrive at and maintain specified coordinate values automatically, whether through electronics, microprocessor control or other means.

Regarding Lenses, Reflectors and Diffusers—The common lens functions are that of condensing, collimating and making more efficient the utilization of the source, for a brighter, more uniform and directional beam. In addition, lenses commonly control, sometimes in conjunction with reflectors and diffusers, the beam angle and dispersion of the light output. As permanent components of a lamp, they provide either fixed or variable means to control intensity and beam characteristics.

Reflectors are often built into lamps with non-directional sources. This includes glowing filaments that emit in all directions, and fluorescent tubes. The reflectors assist the efficiency of a lamp by re-directing source output that is emitted away from the primary direction of the desired lamp beam. Reflectors come in a vast range from mirrored surfaces to simple white painted surfaces. Higher efficiency correlates to more specular, "harder" quality, while a "softer" quality typically correlates to lower efficiency. With most sources types, the reflected light is combined with the source emissions prior to exiting through a lens and/or diffuser.

Diffusers are usually secondary to lenses and reflectors, and serve to create a more even source. They also can increase the effective radiating area of a source, either for direct viewing such as an illuminated panel, or for softening the boundary of shadows on a subject. Diffusers are sometimes permanent parts of lamps, and sometimes temporarily attached to suit varying needs.

Technical luminaires that include both reflectors and lenses have been used in theatrical and photographic industries for generations. Fresnel lamps and ellipsoidal luminaries are two common types with integral reflector and lens used in conjunction with the emitting source. Both types feature knobs or cranks for manual user adjustment or focusing of the projected beam. There are common sources that employ permanent reflectors such as the PAR (parabolic aluminized reflector) bulb. Often, the replaceable bulb is a sealed unit combining filament and reflector. In the case of LEDs, a primary lens in usually intrinsic to the unit, with secondary lenses and/or reflectors added as needed.

In theatrical and stage use, multiple luminaries are often controlled through dimmer boards to mix and match the total light output, color or other variables available by manipulating individual units or the total set. Modern commercial and residential lighting design usually includes multiple sources, each with a desired set of characteristics, which are then controlled through various means, including dimmers, to provide users with a lighting environment that can be tailored to task or mood.

Regarding Thermal Management—High power, white LEDs are unlike incandescent sources in a critical area. Incandescent sources heat a filament in order to radiate visible light. It is quite normal for them to radiate more heat then light and is not detrimental, just inefficient. Tungsten/halogen sources must reach a very high temperature to enact the "halogen cycle" that regenerates the filament and maintains efficiency. High temperature operation is needed. In contrast, LEDs are electronics that must be kept relatively cool for long life and proper functioning. Since high power LEDs generate heat commensurate with their output, they require thermal management to be used in functional lamps. The luminous flux (brightness) of these sources will drop when their junction temperature goes above a threshold value and will continue to drop as temperature increases. Life expectancy drops in similar manner. At higher than rated temperatures, these products incur increased rates of failure, including the possibility of catastrophic failure, wherein the individual unit is irrevocably destroyed, with the potential for subsequent cascading failure across multiple units within an array. This sensitivity to self-generated temperature also makes them unlike fluorescent sources or other gas discharge sources, which typically require no special thermal management. Thus, a high output LEDs carry both general and specific recommendations regarding thermal management from manufacturers.

Commercial Availability of Components—Recent generations of high power white LEDs are available with a predictable CCT range and sufficiently high CRI to be usable in professional photographic applications and for critical viewing applications at office or home or in commercial use. These come from a variety of commercial sources such as Phillips, Osram and others.

Heat sinks, both as individual components and as lengths of extrusion profile, and as custom assemblies are commonly available. In the majority of cases, the material in use is aluminum or anodized aluminum. General LED lamp design recommendations suggest such things as using the entire housing as a heat sink, or incorporating any heat sinks into the total structure of the lamp.

Secondary lenses and diffusing products now exist specifically for high power white LED sources. These are typically made of PMMA (polymethylmethacrylate) and are available in a variety of beam angles and levels of efficiency, with and without holders to mount to specific LED packages. They are available with beam shaping characteristics comparable to existing fixtures of traditional type, and with novel characteristics originating with LED sources.

Constant current drivers and/or ballast products are available for use with AC or DC input and output current or incorporating transformers for use with AC main (line) current. Models exist that permit dimming or varying LED intensity through means such as potentiometers or pulse width modulation. These are specifically designed for high power LEDs, and circuit diagrams for LED array configurations including switching and dimming are provided.

There is an existing technology that involves blending narrow or single wavelength RGB sources with white and orange sources to achieve variable color temperature, according to the teachings of Rahm, et al. (U.S. Pat. No. 6,636,003). That prior art differs from the present invention in that it does not use wide spectrum white LED sources as the exclusive means of generating user variable CCT value white light. It also differs in the areas of integral lensing, integral thermal management and specification of manually responsive controls.

Other existing technologies—There is an existing technology that involves blending of "different colors" of LED light through the use of light guides, to achieve white light with a reliable CCT value, according to the teachings of Ward, et al. (U.S. Pat. No. 7,063,449). That prior art differs from the present invention in that it uses light guides. It also differs in that it does not have high power, high CRI white LEDs of specific CCT value as the only sources, which are then blended to achieve intermediate values. It also differs in the areas of integral lensing with optional diffusers, integral thermal management and specification of manually responsive controls.

There is prior art to combine a white LED of high CCT with an LED source that is warm/amber, to permanently create a blended white light source with a single, uniform, unvarying CCT, according to the teachings of Huang, et al. (U.S. Pat. No. 6,395,564). This is specifically to create a synthesis of white LED light plus warm LED source to form a single intermediate white source. This differs from the method of the present invention in many ways: it does not address variable CCT or intensity, integral lensing, integral thermal management or manually responsive controls.

There is prior art relating to color temperature variations in an LED lamp through the use of dimming, according to the teachings of Melanson, et al. (U.S. Pat. No. 7,288,902). It is similar to the method of the present invention in that it is dedicated to the control scheme of creating variable CCT through the use of selectively or reciprocally dimming white light LEDs, as opposed to through RGB type blending. It differs from the present invention in that: it specifies use of alternating current for dimming; does not include use of direct current input; does not include integral lensing or optional diffusing elements as part of the lamp in order to create a virtual single source with specific or variable directionality and beam characteristics such as reduced color fringing of shadows; does not specify high power white LED emitter sources with high CRI; does not describe or involve integral thermal management or use of the heat sink(s) as structural mounts for LEDs; and does not specify or include reference to manually responsive controls for direct sensory hand-eye control and "feel" by the user (in contrast, it references setpoint type control, indicative of symbolic, non-real-time control). This prior art further differs from the present invention in that current working embodiments (and future embodiments) of this present invention offers professional users a complete functional lamp that relies only on sensory input to achieve light color and quality to match existing or desired sources, and enables non-technical users to exploit variable color temperature without the need for proficiency in deriving setpoint targets or control schema.

Pohlert, et al., in U.S. Pat. No. 7,163,302, discloses a lighting effects system and includes an arrangement of lamp elements, such as LEDs or other light elements on a panel or frame. The panel may include one or more circuit boards for direct mounting of the lamp elements. Different color lamp elements may be mounted on the panel and, in particular, daylight and tungsten colored lamp elements may be used, with their relative intensity selectively controlled. In particular arrangements shown in that patent (FIGS. 38B, 39 and 40), a panel light comprises one or more rows of surface mount LEDs secured to a mounting surface. The mounting surface may be a circuit board which in may be attached to an outer aluminum frame or other preferably light weight material to provide a structural support for the circuit board. Optional fins on the backside of the frame may assist with heat dissipation. Elsewhere in that application there is shown a lens cap which may act as a focusing lens to direct the light output from an LED in a forward (or other) direction.

Other LED light assemblies, such as those shown in Burkholder, U.S. Pat. No. 7,284,882 include thin, flexible circuit boards with surface mount LEDs and other electronic components that are attached to a metal heat sink, such as by using a layer of thermally conductive adhesive. Vias may be incorporated in the circuit board near attachment pads used to bond the LEDs. These vias provide a conduction path from the back side of the LED carrier through the circuit board and through the thermally conductive adhesive and thus to the heat sink.

SUMMARY OF THE INVENTION

In preferred embodiments, the present invention is a light or lamp that allows a user to adjust parameters or characteristics used in the control of emitted white light, specifically quality, intensity and color temperature. The invention permits users with technical proficiency to accomplish their control functions faster and easier. The invention permits users without technical proficiency to accomplish control of these parameters to a degree previously beyond their skill. It will also allow all users, whether professionals or not; to alter the light output of an embodiment of this invention to match, complement, or augment the ambient or available natural or artificial light.

The invention results in fully functional lamps, lighting instruments and luminaires that are novel in their combination: high power, high CRI, white LED sources; integral thermal management that also functions as LED structural support; integral optics (secondary lenses) with accommodation for diffusing elements; and manually responsive controls (defined below) that circumvent the need for technical lighting proficiency while not inhibiting the proficient.

Embodiments of the current invention can simplify the tasks of professionals who employ lighting, and bring a new level of control and functionality in lighting to the general public who are not proficient in the theory, nomenclature or methodology of light modification.

White Light LEDs—This invention uses single unit or arrays of high power, high CRI (Color Rendering Index) white LED's as the light sourc(es). In a preferred embodiment, the invention creates groups of these, each group of a specific but different color temperature (more accurately Correlated Color Temperature or CCT). These groups are typically comprised of one or more units. As an example, fully functional embodiments of this invention have used groups of six and nine LEDs per CCT group, with preliminary designs for from two up to 96 LEDs per group. Each group is configured into functionally isolated circuits for the purposes of user control. Circuits are either series, parallel or series/parallel, with selection of circuit type independent of function.

The invention uses high power, white LEDs with good color rendering characteristics, evaluated either as having emissions that are close to that of the Plankian locus on the CIE chromaticity chart, or by having a relatively high CRI, compared to other discontinuous spectral output sources.

Compared to methods that utilize blending of primary (RGB) or primary and secondary colors, the method of the present invention significantly lowers system complexity. It also has the potential for increasing utility, in that non-technical users can exploit the color temperature variations to match conditions, such as time of day, without being conversant in technical lighting language, metrics or settings.

A potential problem inherent in RGB blending is that of erroneously arriving at color coordinates far removed from the blackbody locus, through operator error or failure of any aspect of the complex and sensitive feedback loop that tracks these coordinates. This is obviated in the current invention, through the exclusive use of white light sources, which only produce full spectrum white light in proximity to the blackbody locus, regardless of CCT. Even if user controls totally fail in the current method of invention, only white light is output, making it more robust and fault-tolerant.

Thermal Management—The invention also optionally but preferably incorporates thermal management into its method and apparatus. This can include the subassembly of LEDs on a printed circuit board with metal core (MCPCB) or metal plate, or direct mount of the LEDs to the heat sink. The LEDs are thermally coupled to the heat sink (including any and all intermediate mounting structures) through thermal adhesive, thermal tape, or mechanical assembly with addition of thermal grease or compound. Appropriate thermal management results in sustainable LED intensity and spectral distribution performance, and avoids specific types of source deficiencies and potential failure modes. The invention utilizes heat sinks as the physical structures for LED support, whether singular or plural. In addition, the invention includes a housing configured to hold the component elements and function as the total lamp, or to be mounted within or upon another structure to function as the light or lights within the total lamp. Embodiments of the invention may use the heat sink element or elements as a large portion of the total housing.

Heat sinks for electronics are typically attached to, or are enclosed within housings, to dissipate heat, thereby protecting thermally sensitive components, sometimes in conjunction with fans. They are addendums to the structure. By way of analogy, they are the "riders" not the "carriage". The current invention exploits the structural soundness and materials compatibility of available heat sinks to use the heat sink as the primary structural mount and support for the LED or array, whether attached to other structural members or a housing, or forming the preponderance of the total lamp structure or housing itself. By continued analogy, the heat sinks are now the "carriage", not the "riders".

Lenses, Reflectors, Diffusers to Provide A Single Virtual Source—Secondary lenses for LEDs serve the same function as primary lenses for other light sources and will be referred to simply as "lenses", accepting that they are added components to the LED unit. The LED source has a significant difference from traditional sources that create an additional need to modify the emitted light. LEDs are very small point sources and as such, they are typically used in quantities greater than one to have sufficient intensity for functional lamps. In preferred embodiments of the current invention, there are always at least two LEDs in the lamp. By nature of being physically offset in one or more dimensions, LED arrays cast multiple shadows that are disruptive to critical viewing and photographic uses. Of particular note is that when white LEDs of differing color temperature are used simultaneously, the shadow of one CCT source will be colored by the output of any other CCT source, resulting in disturbing and disruptive patterns of offset colored shadows.

Therefore, it is desirable to blend the output of more than one source to create a virtual single source, with a commonality of direction, resulting in the blending of shadows and reduction or elimination of distinct multiple shadows of differing coloration.

The invention thus preferably incorporates a specific geometry of secondary optics (lenses) as the method and apparatus to utilize LED light output with greater efficiency, for better control of directionality, and to introduce beam characteristics that are superior and more usable than LED output without secondary lenses. Of particular significance is that LED's with different CCT's will create multiple shadows of differing color if the beams are not blended. This creates shadow patterning closer to "op art" than normal shadows, and would be distracting in residential or non-professional settings and completely unacceptable in photographic industries. In the method of the invention, LED output is combined into a virtual single source, or functional groups of sources, with integral lensing to collimate sources, combine beam angles and create a more even and uniform beam, with blended and "normalized" shadow qualities.

The invention also includes the option of reflectors or reflecting surfaces as integral to either lamp head housing or within the total lamp, external to the lamp head. This is to help direct and concentrate, or bounce and diffuse light, depending on reflector type, size and position relative to the source(s). Unlike lamps with incandescent sources, LED lenses are typically affixed directly to the component LED, so that the light reflected is post-lens not pre-lens emissions.

The placement and size of the housing sidewalls relative to the beam angle of the array is functional in some embodiments of this invention. This is because the lenses used can effectively combine the beams of all the LEDs to form a reasonable consistent CCT except for a small fringe at the edges. Therefore, in one or more embodiments, this edge fringe is "cut" or curtailed and reflected back into the total combined beam to prevent color fringing of the total beam. In these embodiments, the sidewalls are treated as reflectors, with appropriate finish and coloration, typically natural aluminum or white.

The method of the invention also includes housings and lamps that provide the option of attaching, temporarily or permanently, diffusing elements that create more uniform beam dispersion and reduce the effects of both unwanted multiple shadows and degree of directionality. In some embodiments of the invention, diffusers may cover the entire lamp, and in others diffusers may cover only part of the lamps total output or even a single source within a larger group or array. This enables embodiments that offer a multiplicity of lighting qualities and characteristics within a single lamp. An embodiment for photographic use incorporates a track to slide in a selection of diffusers to meet user needs. An example of a residential embodiment would be a ceiling fixture for a dining room that provides both directed light for the table surface and ambient, non-directional light for the room, which could be independently controlled. Another example would have some diffusion elements fixed in position and some movable, manually or by mechanism, for another axis of variability: that of "hard" vs. "soft" output.

Manually Responsive Controls—The term "manually responsive" control is used here to identify and categorize controls that require a physical action on the part of the user that results in and correlates directly to end responses concurrently assessed by the visual senses, to enable hand-eye coordination and perception of "feel" for the variable or variables in control. This includes but is not limited to control actions such as turning a knob, adjusting a slider, flicking a switch, or moving a joystick or any type of physical displacement encoder. This is distinguished from controls that are symbolic in nature, where the physical input has no direct correlation with the sensory cues derived from the output, as is the case with keypad control, assignable buttons or menu driven controls, or setpoint controllers, as examples. This distinction is not accurately captured in the labeling of manual vs. electronic, or digital vs. analog controls, in that electronic or digital encoders and computer interfaces such as digital tablets provide direct correlation between physical action and sensory results, and are used and specified for exactly that reason. In non-technical usage, digital input devices with these characteristics are often called "analog", despite their function, mechanism of control or output.

Manually responsive controls allow for rapid adjustment across a continuous range of values, without requiring an intermediate setup or calibration process mediated by electronic or manual means such as setpoints or programming. Manually responsive controls are those in which physical action correlates in real-time, directly and unambiguously with human sensory input and feedback, including but not limited to those such as switches, rotary knobs and encoders, sliders, joysticks or directional stick controllers and encoders. They are particularly useful for manipulating subjective criteria relating to artistic intent (in photographic uses) or mood/feel (in commercial or residential uses).

For example, when controlling subjective criteria in a professional photographic environment, technical assessment is often subsequent (not prior) to the arrival or discovery of the desired setting, and recorded for use in subsequent matching. The method of the current invention utilizes these types of manually responsive controls to provide the desirable user functions of hand-eye coordinated adjustability. They do not interfere with technical proficiency, but instead speed up the process of arriving at subjectively evaluated settings. They allow the non-proficient to arrive at results previously unobtainable by those without technical skill, through the linking of direct perception with standard and easily comprehended manual controls within the experience base of the general public.

The significance for this invention is that manually responsive controls provide users with "feel" for the lamp function and variable characteristics in an unmitigated, hand-eye coordinated experience of responsiveness. This is in contrast with menu driven user interfaces or symbolic controls such as setpoint and types of automated control. Manually responsive controls can be integral to the housing or lamp head, or external to one or both, and part of the physical structure of the total lamp. They may also be fully external to the structure of the lamp in physical embodiment, but are. integral to the invention. Embodiments of the invention that employ external control may have the controls that are wired or wireless in connection to the lamp.

In the method of the current invention, lamps can be made that will serve multiple functions of existing lighting and do so with less time, trouble and effort than those currently used by photographers, videographers, cinematographers, graphic designers, architects, lighting designers and others who engage in imaging or critical viewing. In addition, lamps can be made that provide non-proficient or home users with control of parameters such as color temperature that were previously too complex technically to execute reliably.

Potential Applications and Benefits

A primary use for this invention is in imaging with photographic means, whether still or motion picture, film, video or digital. Since the advent of color imaging and artificial light sources, there has been the technical need to control color temperature or CCT through light selection, color gelling of lights, filtering of lenses, selection of filmstocks, and white balancing of video and digital photo and motion picture systems. New lights made with this unique invention will give users easy, reliable control of CCT to match or complement existing or ambient light on their subject, and can be assessed by eye or through technical means such as a color meter.

These embodiments of the invention would be controllable in a manually responsive way that is novel in its specifics, but completely in line with accepted practices. This is will give users the "feel" of direct physical control of lighting parameters in a manner that is desirable in an industry where high proficiency of hand-eye coordination and visual acuity are the norm. The distinct and widespread preference in the imaging and photographic domains for manually responsive control is expressed in numerous product reviews of cameras and camcorders, wherein product features such as electronic or servo type focus mechanisms are evaluated and judged for the presence or lack of end stops for responsiveness and "feel" like higher end professional camcorders and film cameras which have manual mechanisms. Zoom servos are likewise consistently reviewed and evaluated for how well they match the function and feel of cam driven or screw driven high end film or video lenses, as opposed to sluggish or non-repeatable "feel" of lower end servo devices, that diminish user feedback, control and resulting image quality.

Another use for the invention is for critical viewing applications in commercial or professional settings. For example, graphic artists must critically evaluate materials under conditions wherein they will ultimately be used, or under varying lighting conditions. Lights made with the method of the present invention can be used to match a range of CCT's at will. This would also be true for designers, artists, architects and others who engage in critical viewing as part of their professional tasks. Current technology for this application is the "light box" with a single, unvarying color temperature or CCT value of approximately 5600° K. As with the population of photographic professionals, there is a significant subset of professionals engaged in critical viewing who desire manually responsive control of tools and instruments, since hand-eye coordination and qualitative manipulation of tools and effects are part of their stock in trade.

Another use is in commercial or residential settings where it is desired to track lighting conditions such as those related to the time of day, and changes from predominantly natural day and sunlight, to nighttime and artificial lighting situations. It would be highly desirable to be able to track these changes in ambient lighting, or to create different moods or quality of lighting through varying CCT at will, in a continuous manner. Examples include hotel lobbies and public building spaces where a crisp and clear daytime "look" may be contrasted with or blended into a more intimate and warm nighttime "look". The ability to provide, through the method of this invention, lamps with source arrays in three dimensions, plus variables in lensing, reflectors and diffusion elements, would enable lighting designers in this field to offer their clients a completely new method of articulating and controlling their lighting environment, particularly through exploiting the mechanism of manually responsive controls, much like those for video games, as the means of "feeling" and "tweaking" any parameters available through the method of this invention. Instead of programmable controls that distance the user from the experience, users could "play" the light and adjust at will, in an intuitive manner.

Embodiments of this invention as workplace lighting would permit users to track ambient conditions at will, depending on proximity to any natural light, existing lighting within the workplace, and time of day. In this manner, lighting of color temperature contradictory to the setting could be eliminated or ameliorated, with resulting eye strain and visual fatigue minimized.

Home users could use embodiments of the current invention for, as an example, a dining room light that features a "homework" setting with a preponderance of direct light at relatively high color temperature for the afternoon, and a "dinner" setting with warmer lighting and greater ambient vs. direct characteristics. Users would have the ability to manually and responsively control factors such as total ambience and task light, CCT, total and source sub-group intensities. In one embodiment, directional stick encoders can be assigned values for warm and cool, light and dark, ambient and task intensities, to permit non-symbolic, direct hand-eye coordinated control of mood and function. These can be adjusted in real-time, without resorting to intrinsically asynchronous multi-level, menu-driven control. By contrast, the type of symbolic or programmable control to execute even a subset of these functions would be beyond the technical level of most users. With embodiments of the current invention, users can move a joystick and get results, so there is no need for proficiency in the theory or nomenclature of lighting. These lamps would delight parents and children, in addition to providing needed light with desired characteristics.

Many people already buy specialized lighting in order to have a "warmer" or "cooler" source for a particular time of day or specific activity, including reading lights, task lights and overall ambient lights. Lamps embodying the method of the current invention would enable users to track these functions in a direct and fundamentally intuitive manner from the same lighting unit for time of day, mood or activities. There would be no need for separate, specialized lamps serving the same or similar functions.

In addition, new high power white LEDs are relatively energy efficient, comparing favorably with fluorescent or compact fluorescent sources. They typically also have a significantly longer expected life compared to other artificial light sources, sometimes in orders of magnitude. Therefore they are, generically, more environmentally friendly and less wasteful, in these terms.

Using the present invention, a light of almost any desired size and luminous intensity can be designed and made, since the only requirement is scaling up the number of LEDs within an array or arrays of one CCT, plus those of one or more differing CCT values, plus the associated electronics, drivers, optical systems, etc.

This invention has one embodiment utilizing LEDs of only two different CCT value, high power, high CRI white LED sources or arrays. In other embodiments, numerous CCT value LED groups can be utilized, to enable continuous variability across intermediate CCT values, with more consistent total intensity. This is considered within the method of the present invention, given that at least one LED manufacturer currently provides 12 usable LED CCT values tracking the curve of blackbody locus in current literature on available product.

Because the high power, white LEDs have a small physical size, embodiments of this invention can be extremely small. Because it is scalable, it offers possibilities of larger, high intensity lamps, so that embodiments of this invention could replace larger, high intensity sources currently in common use. Since the modular packages of LED source, lens, and heat sink, with optional reflectors and diffusing elements, are capable of mounting in three dimensional as well as two dimensional forms, it becomes possible to create lamps that utilize physical space and articulate lighting in novel, useful and aesthetically pleasing ways. Because high power white LEDs are energy efficient, extremely long life, standardized sources, lamps embodying this invention can be more environmentally friendly than current, commonly used lamps.

Embodiments of the current invention can simplify the tasks of professionals who employ lighting, and bring a new level of control and functionality in lighting to the general public who are not proficient in the theory, nomenclature or methodology of light modification.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

At least one of the following drawings are executed in color. Copies of this patent or patent application publication with color drawings and photographs will be provided by the Office upon request and payment of the necessary fee.

Figure 1A:
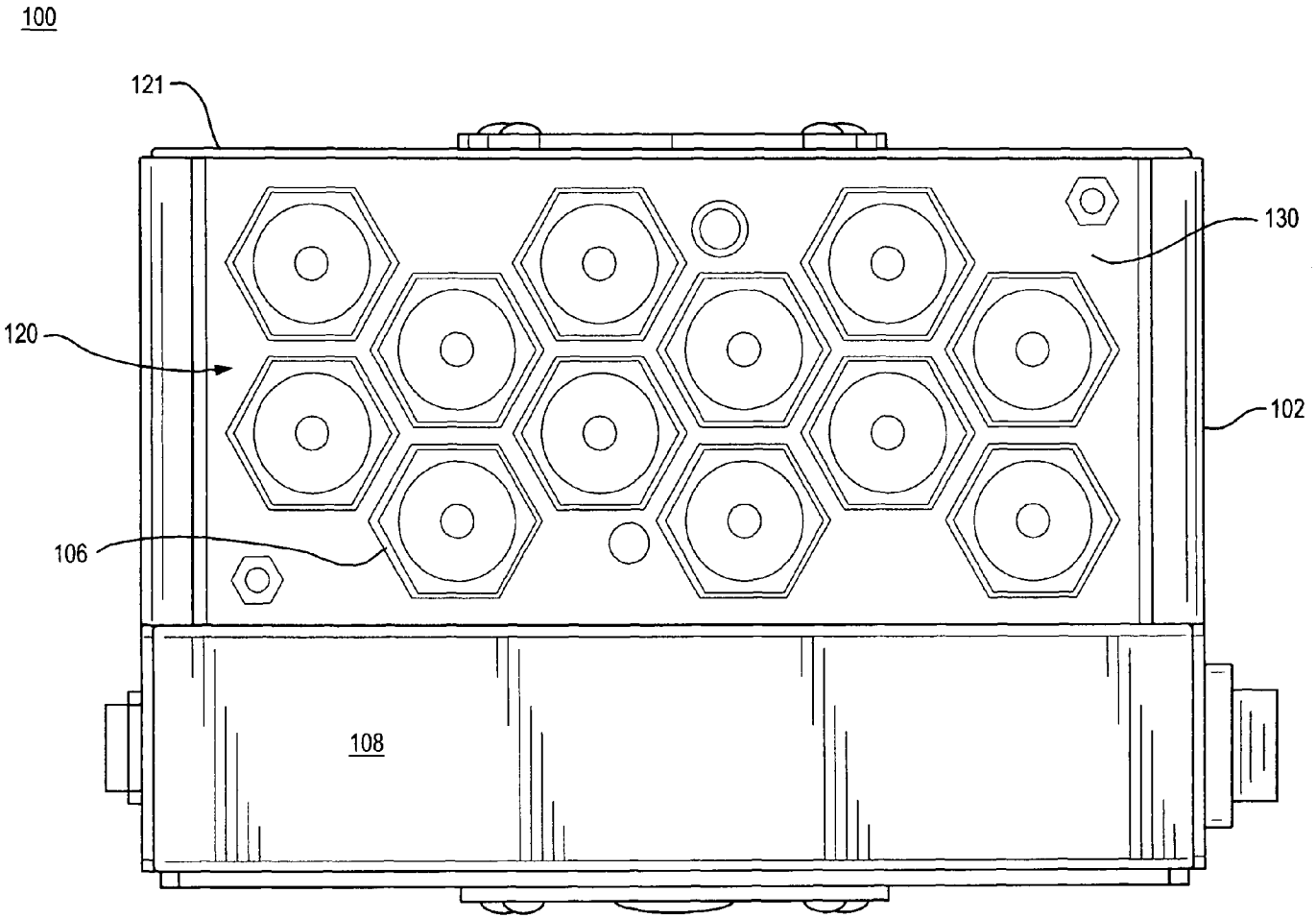
Figure 1B:
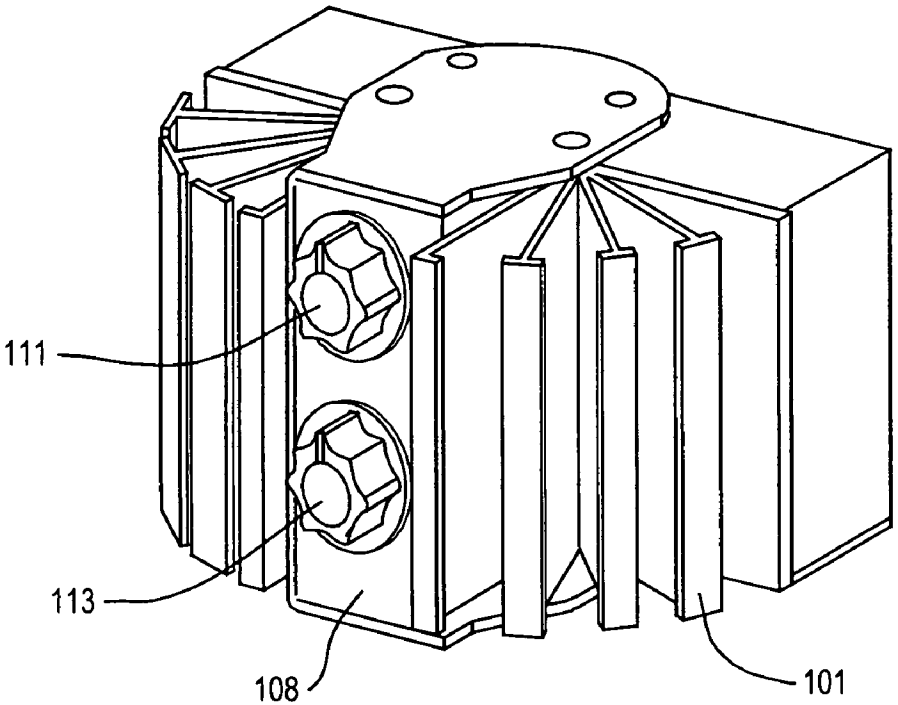

FIGS. 1A and 1B are a front and rear perspective view of a lamp according to one embodiment.

Figure 2B:
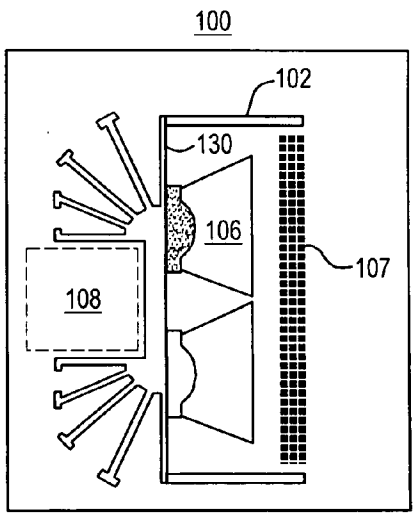
Figure 2A:
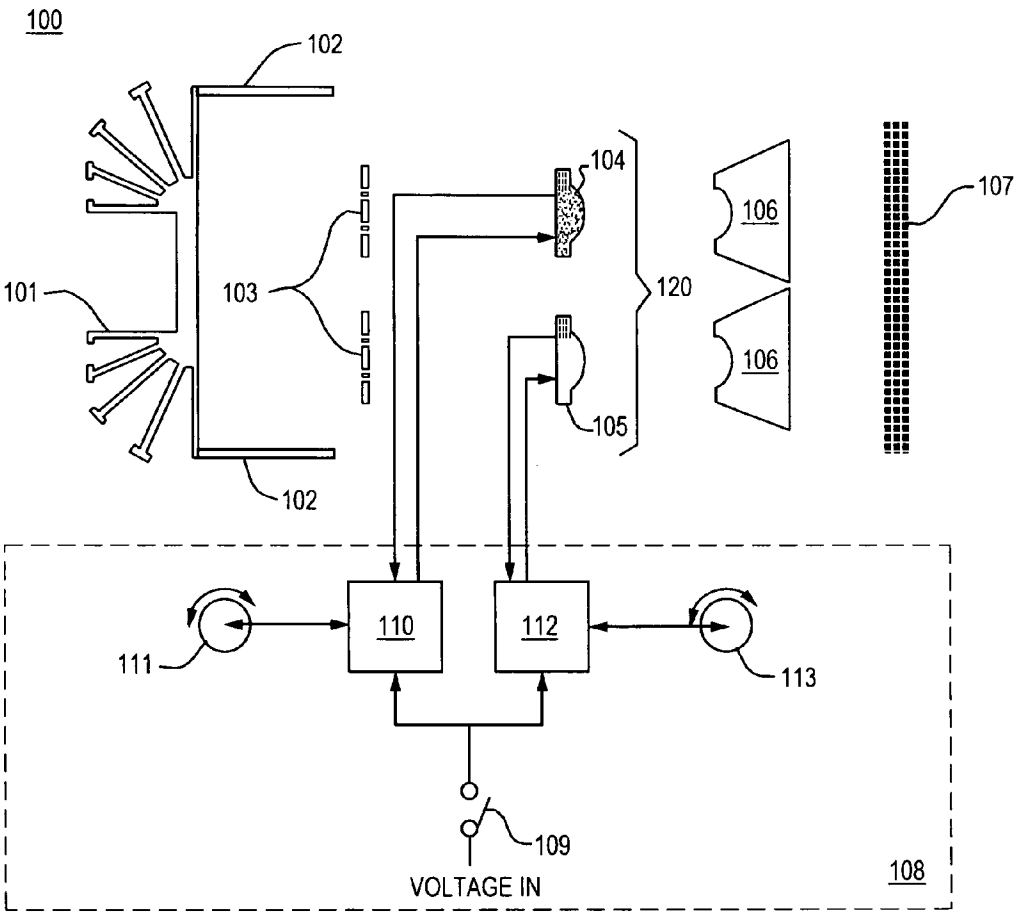

FIG. 2A is an exploded schematic view of a lamp according to one embodiment.

FIG. 2B is a cross sectional schematic view.

Figure 3B:
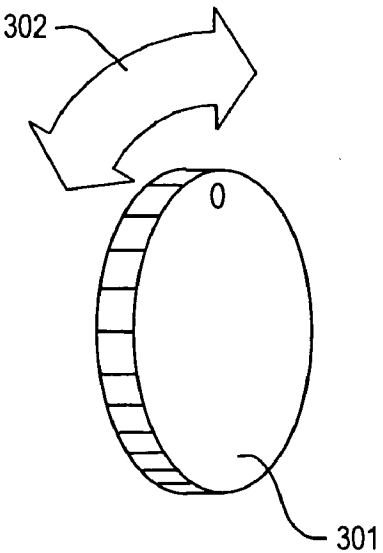
Figure 3A:
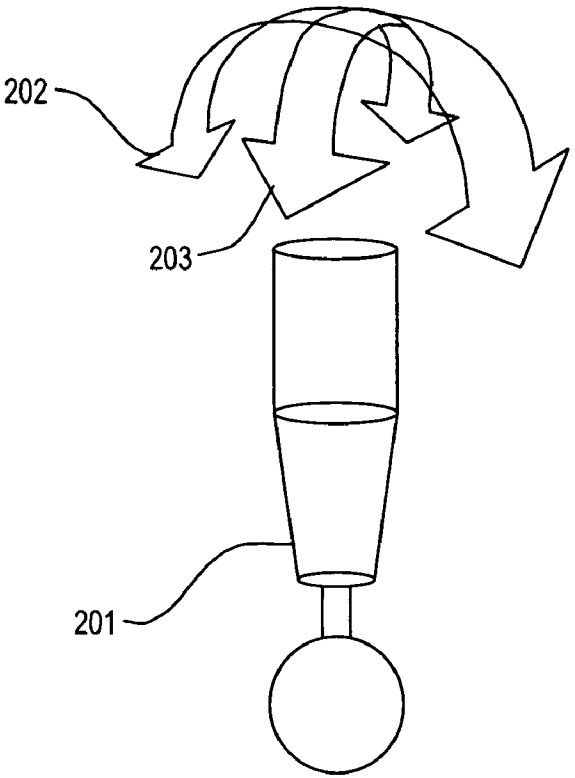

FIGS. 3A and 3B are schematic views of alternate controller embodiments.

Figure 4:
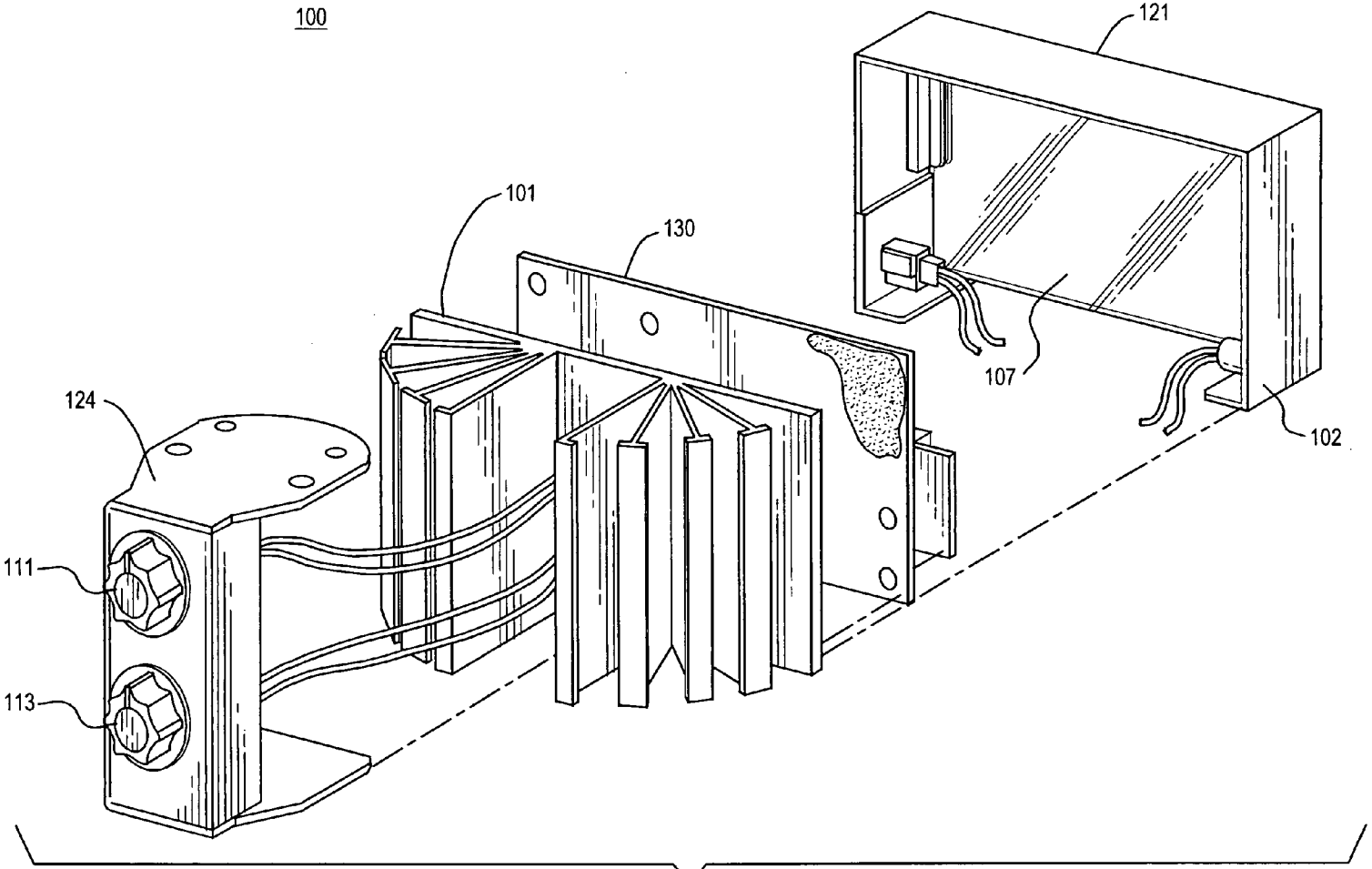

FIG. 4 is an exploded rear view of the components of the lamp.

Figure 5:
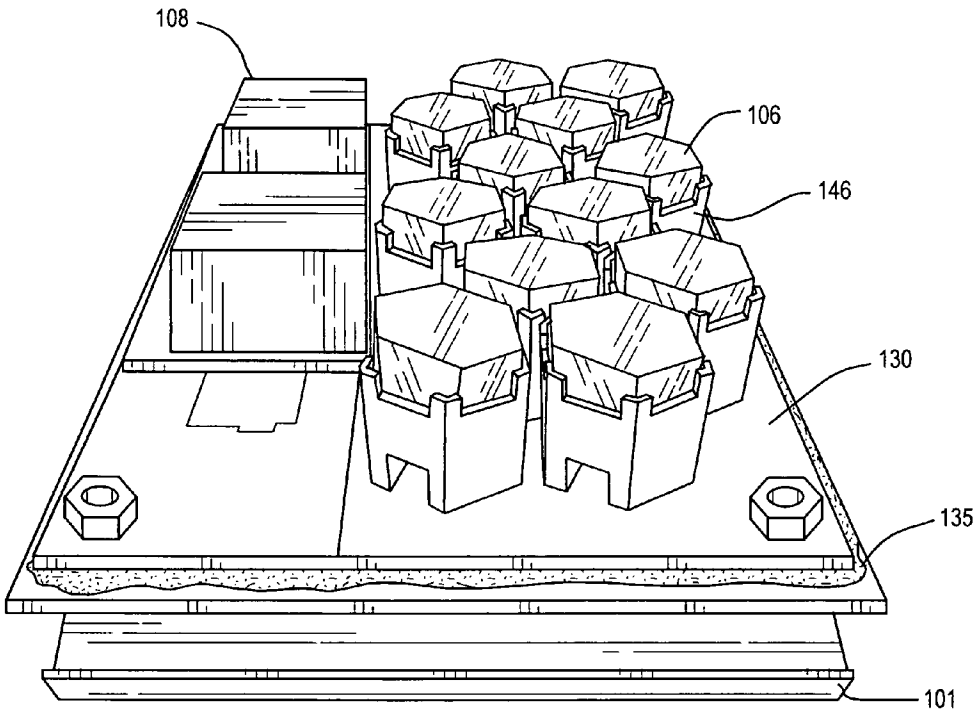

FIG. 5 is a more detailed side view of portions of the electronics subassembly showing the heat sink being used as a support for a Metal Core Printed Circuit Board (MCPCB) that carries the electronics and multiple Light Emitting Diode (LED) light sources.

Figure 6:
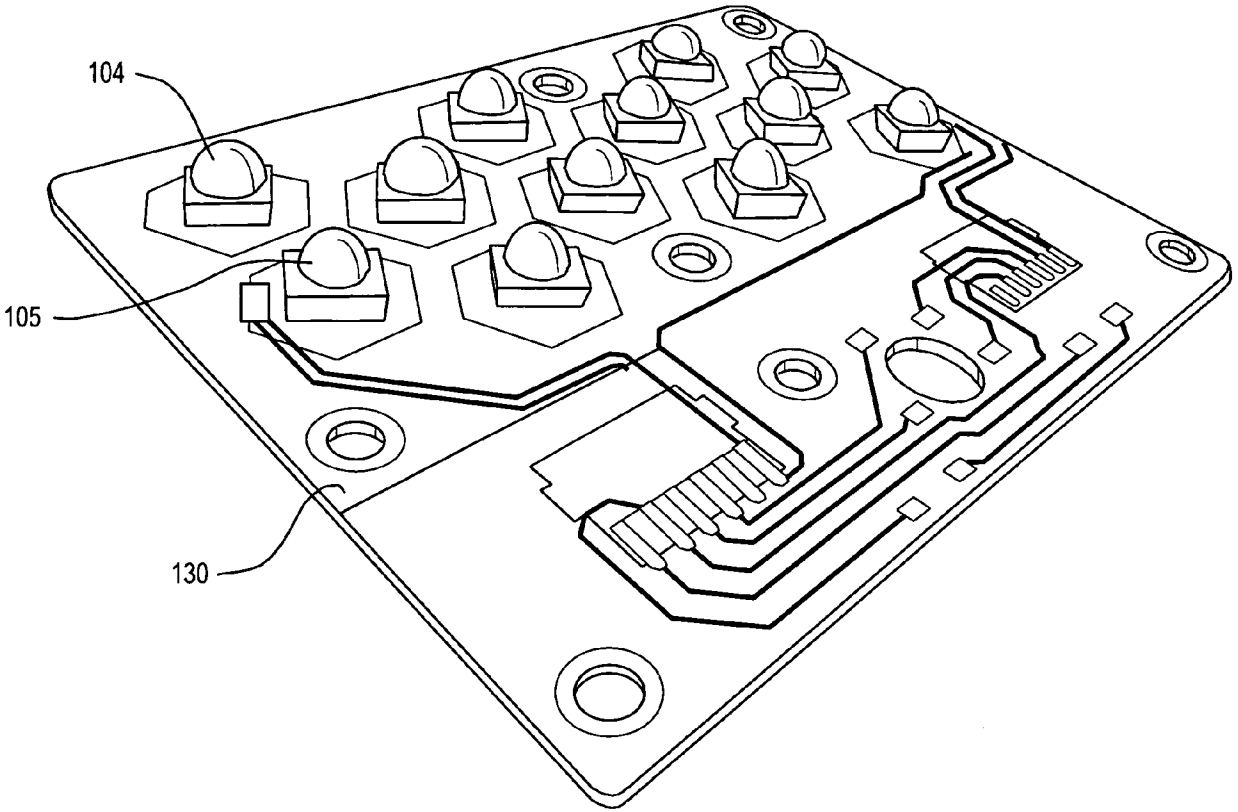

FIG. 6 is a perspective view of the circuit board with secondary lenses removed from the LEDs.

Figure 7:
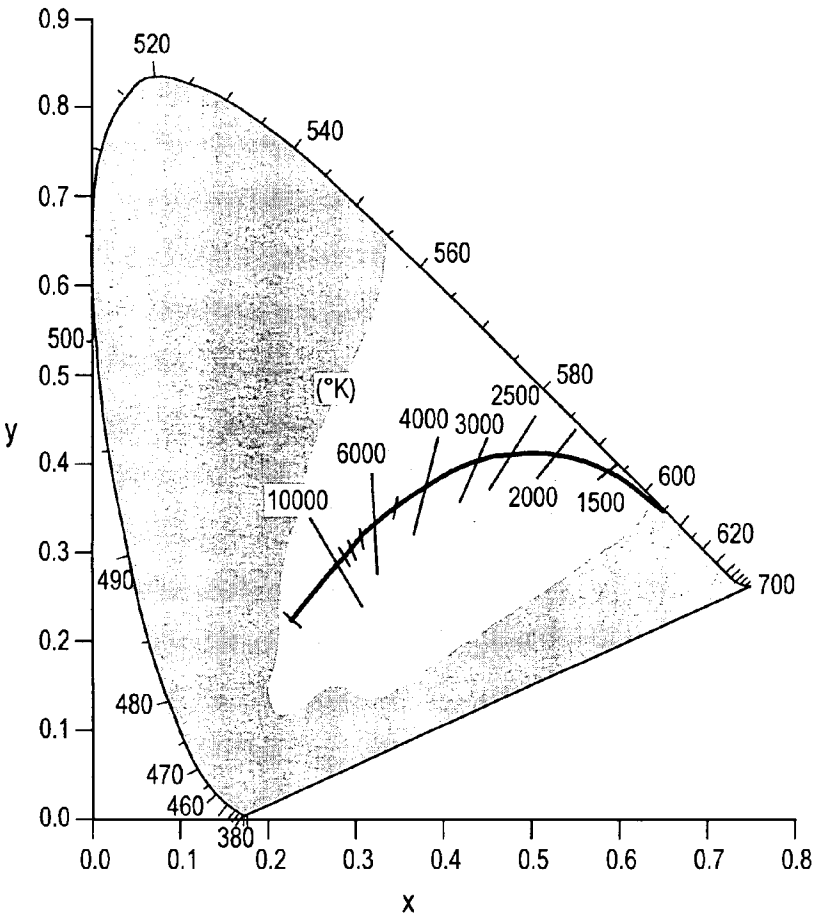

FIG. 7 illustrates CIE chromaticity showing blackbody locus.

Figure 8B:
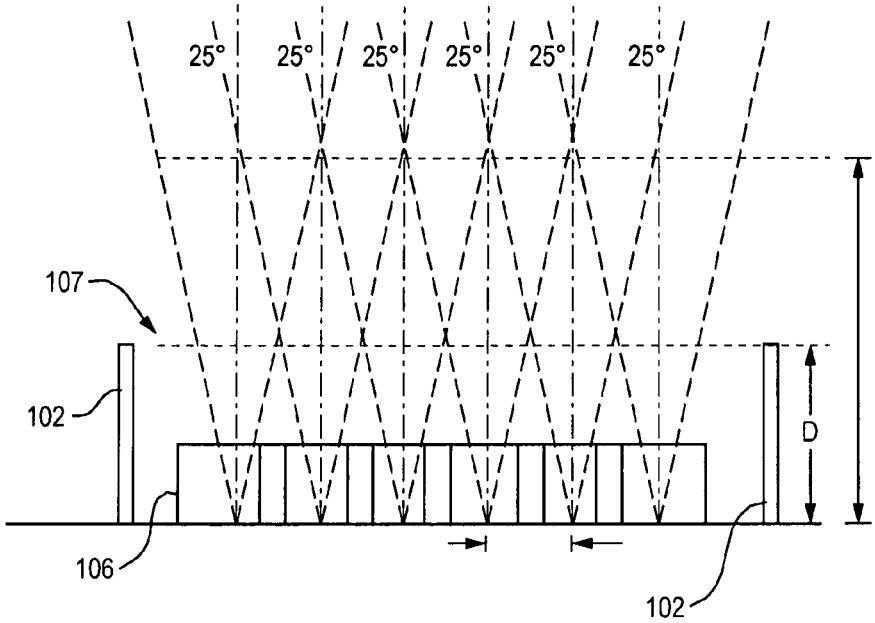
Figure 8A:
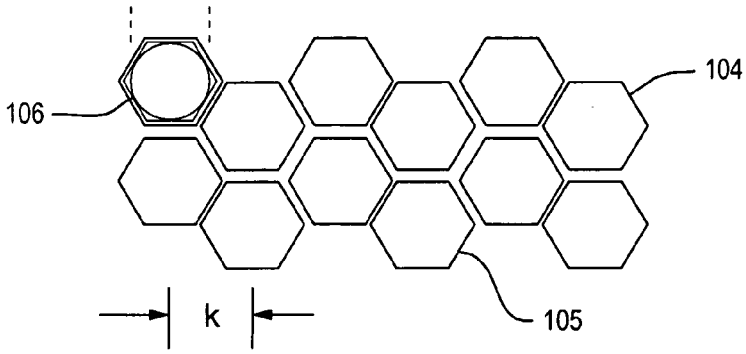

FIGS. 8A and 8B illustrate a geometry for the secondary lenses in one embodiment.

Figure 9:
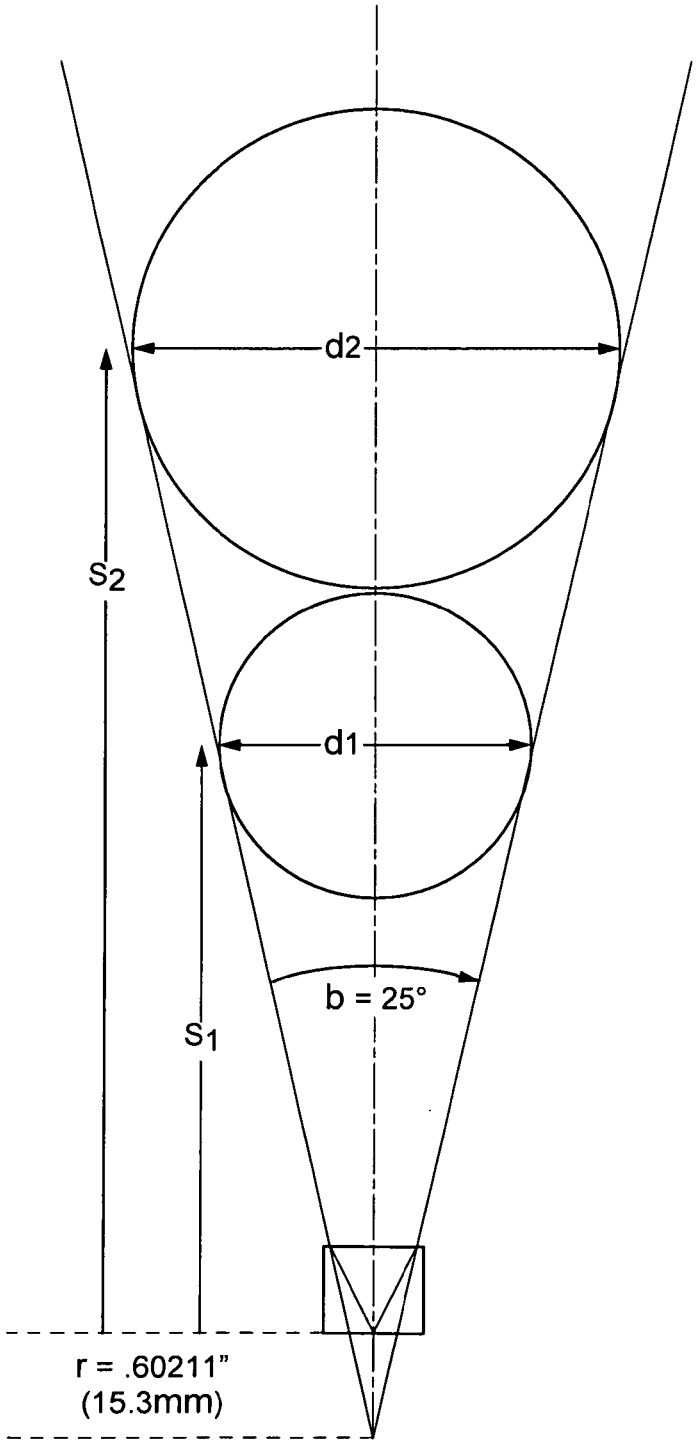

FIG. 9 is a projection of beam circles at two distances.

Figure 10A:
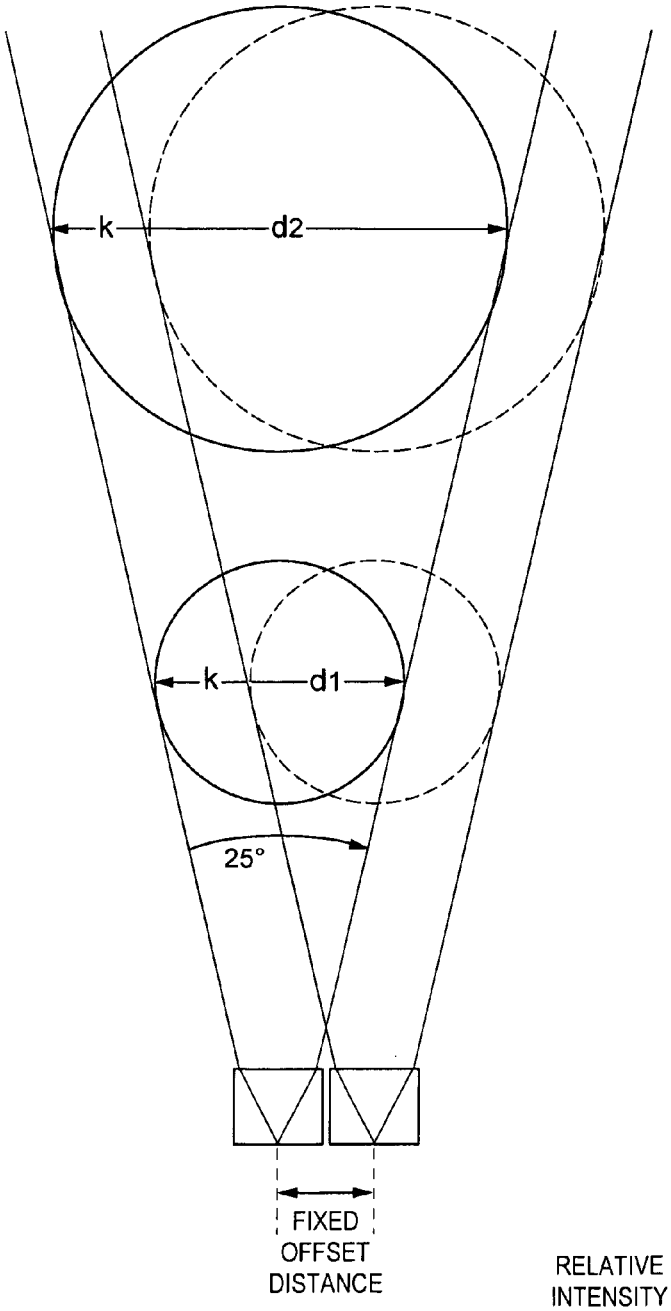
Figure 10B:
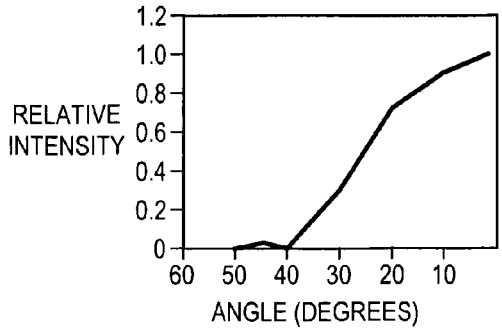

FIGS. 10A and 10B area projection of two adjacent beams and a curve of lens intensity versus angle.

Figure 11A:
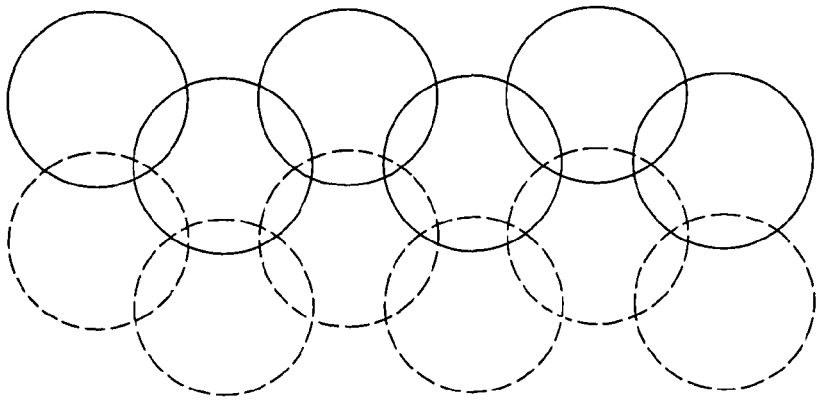
Figure 11B:
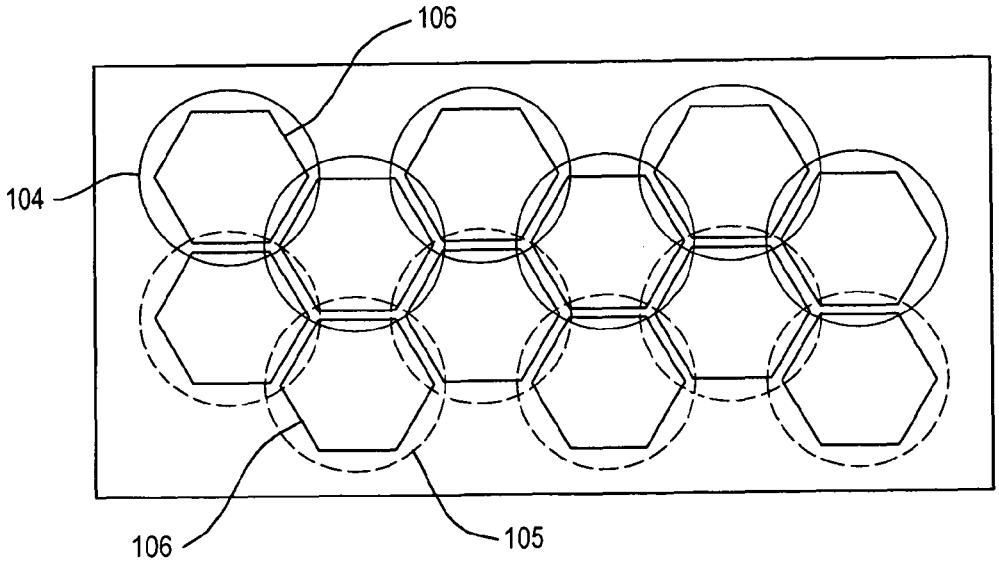

FIGS. 11A and 11B show a beam projection of 25° at a distance of 1⅛" and a diffuser slot area.

Figure 12:
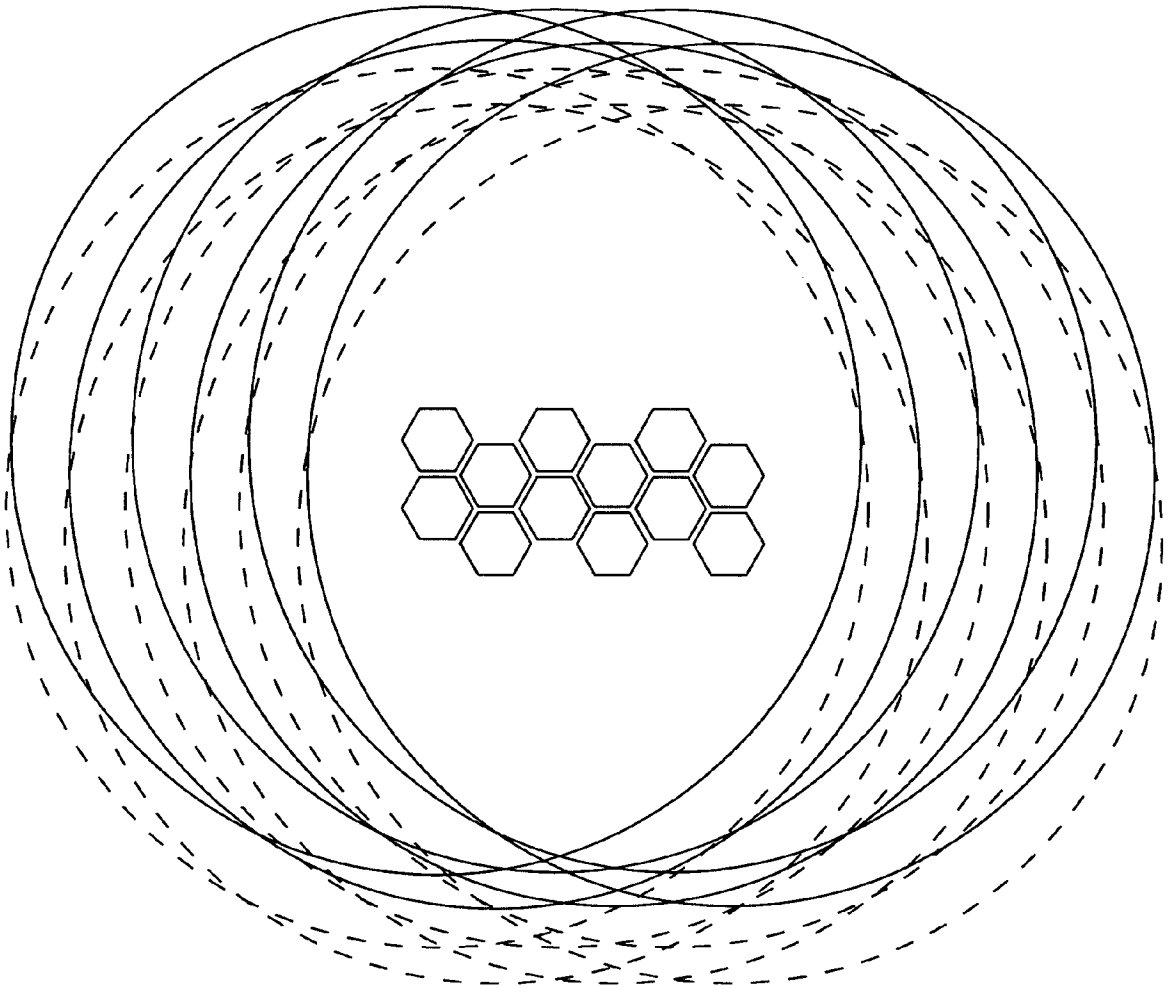
Figure 13:
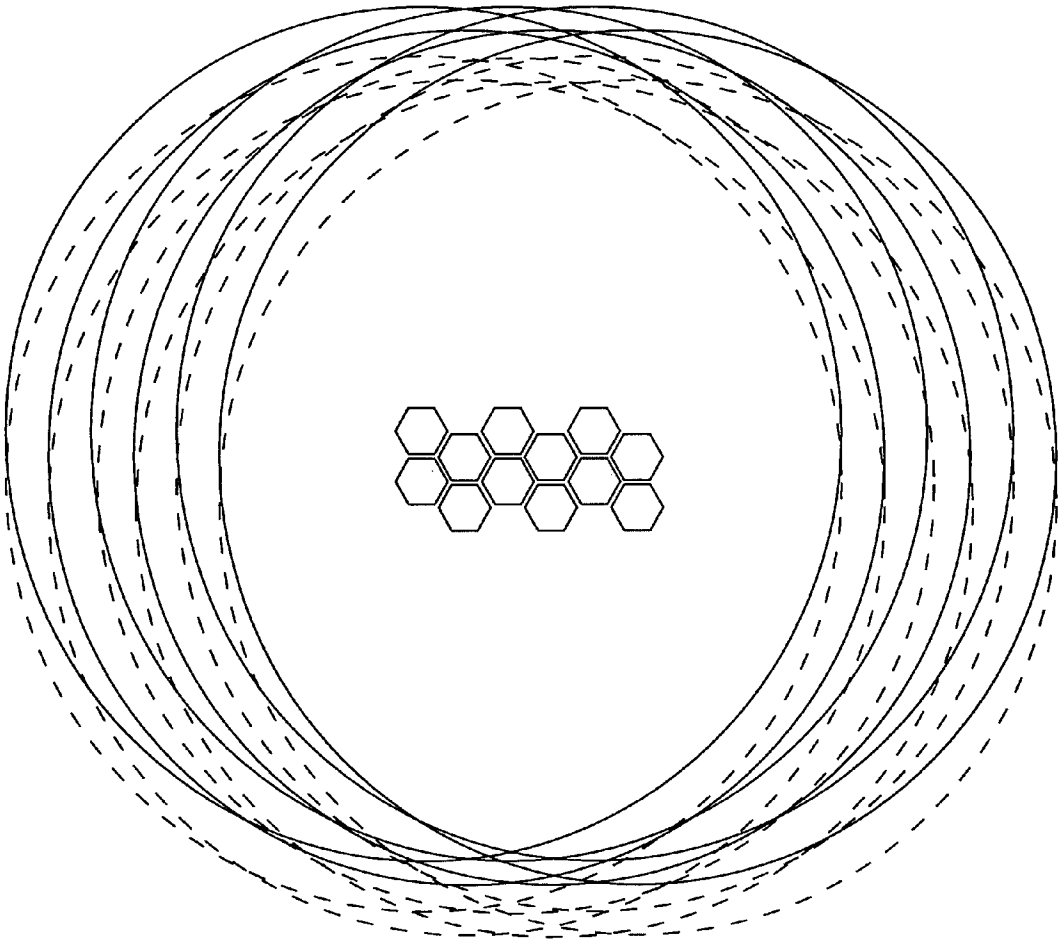
Figure 14:
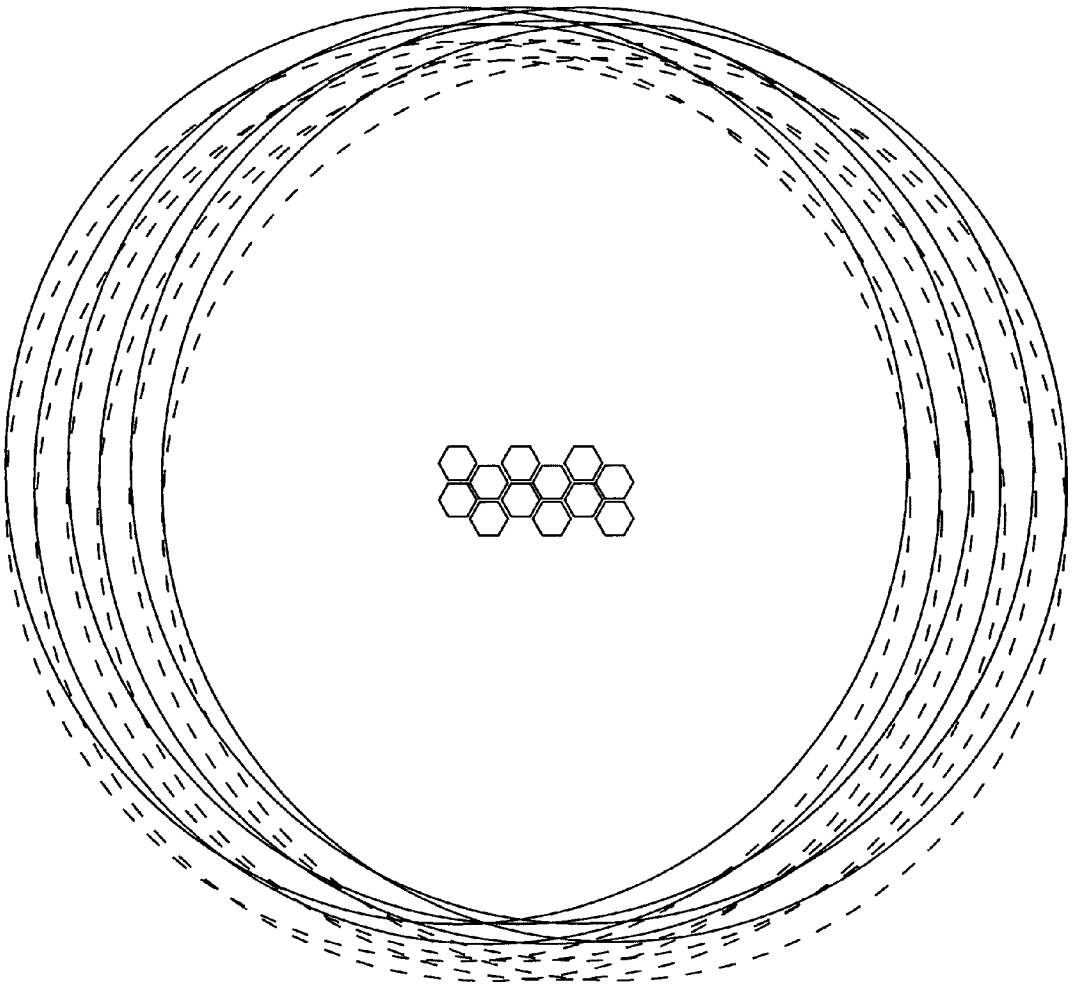

FIGS. 12 through 14 are superimposed beam circles at various distances.

Figure 15:
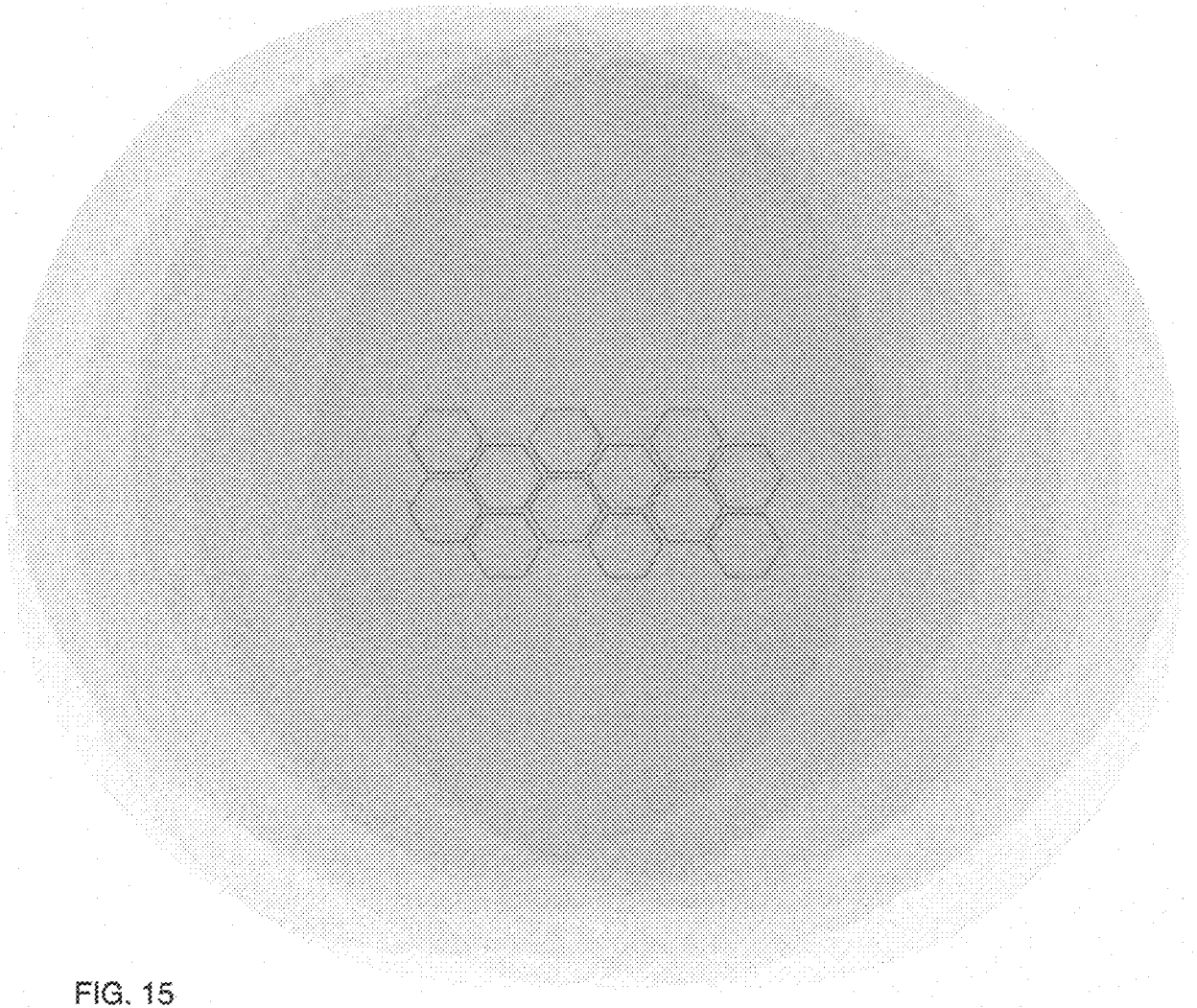
Figure 16:
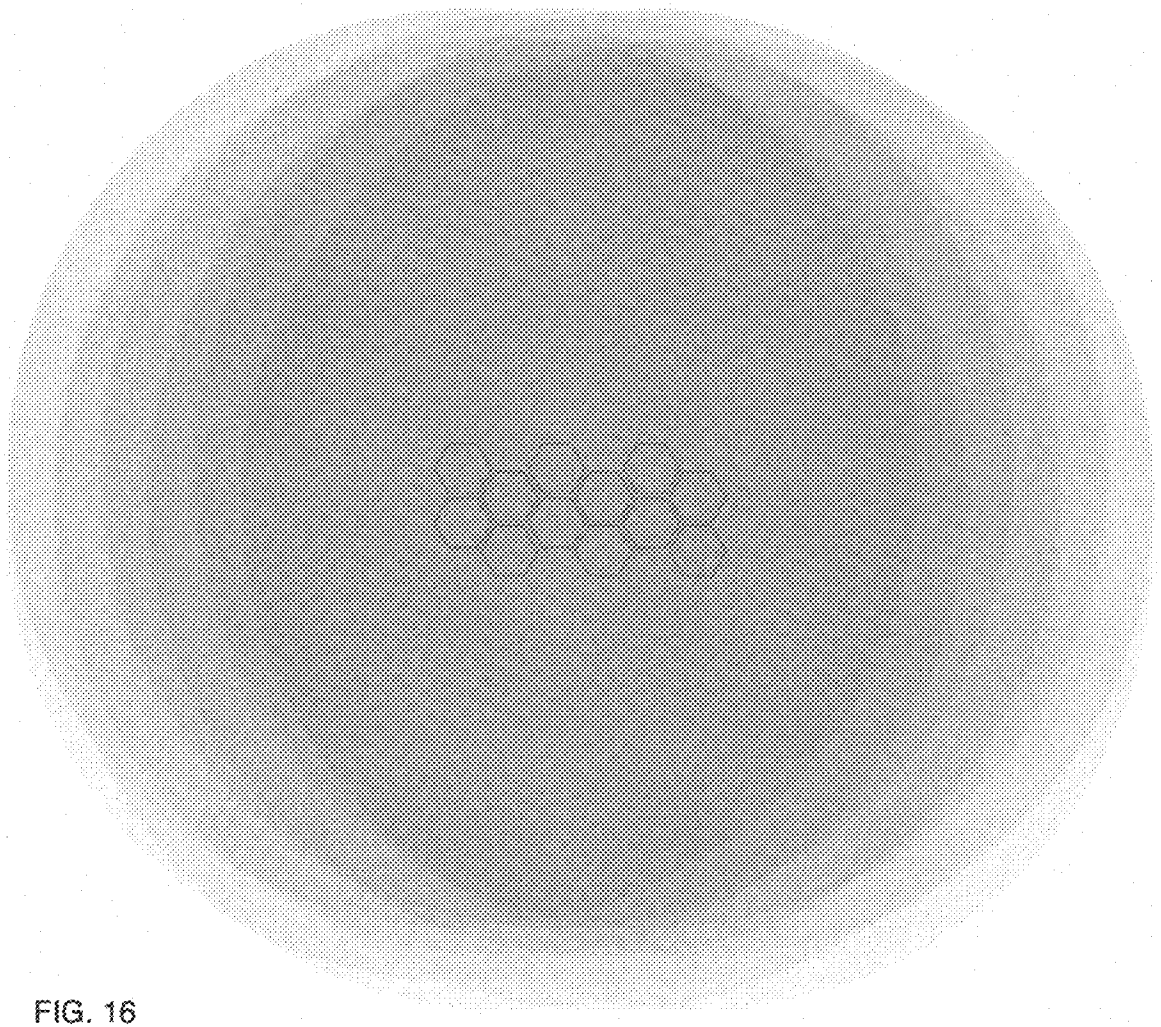
Figure 17:
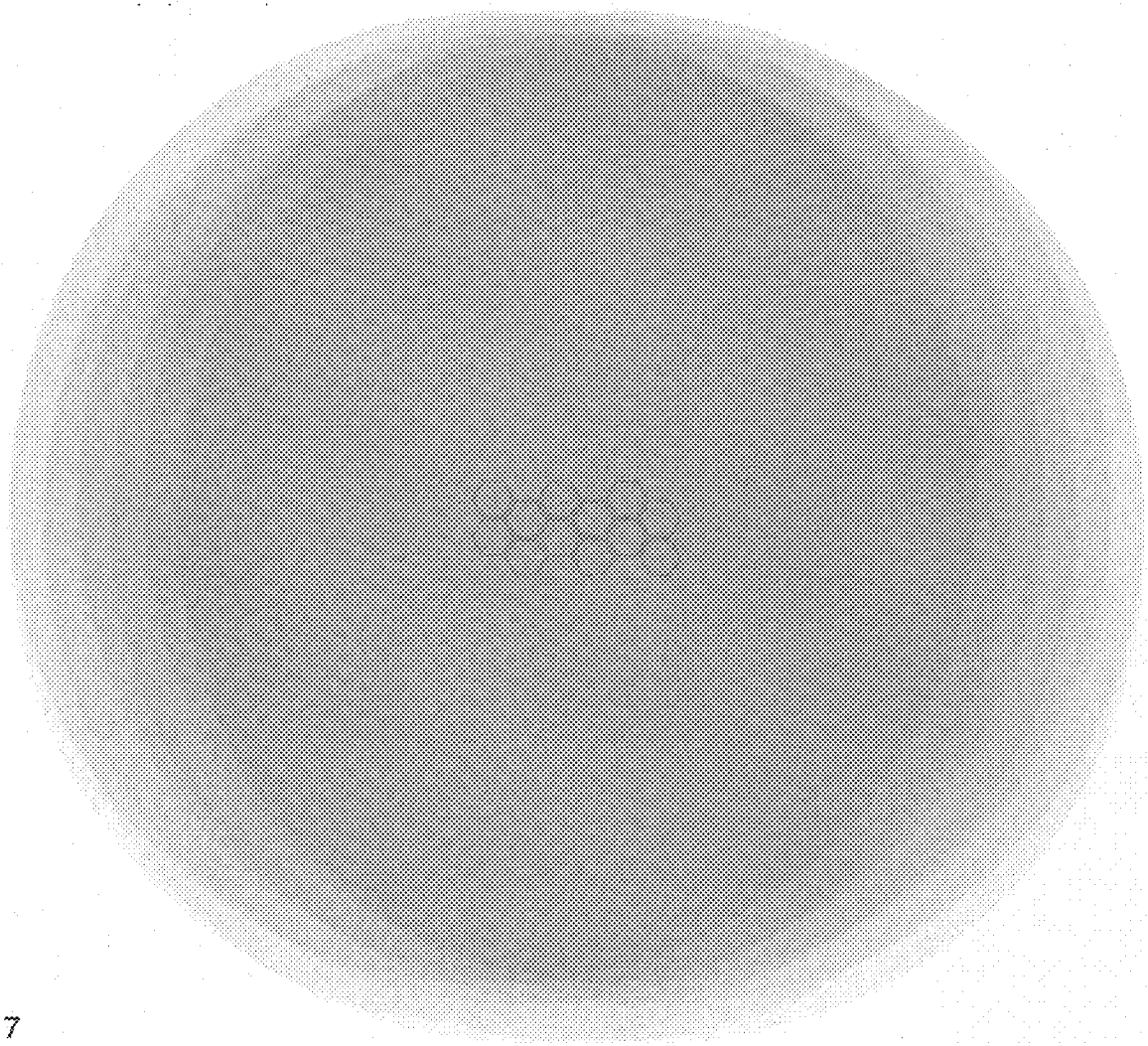

FIGS. 15 through 17 are color images of the corresponding beams showing color fringing effects.

Figure 18A:
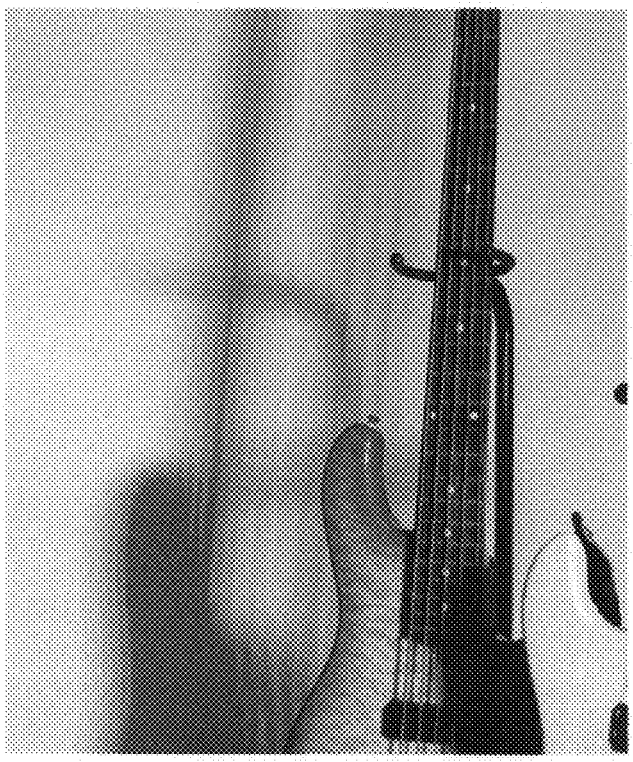
Figure 18B:
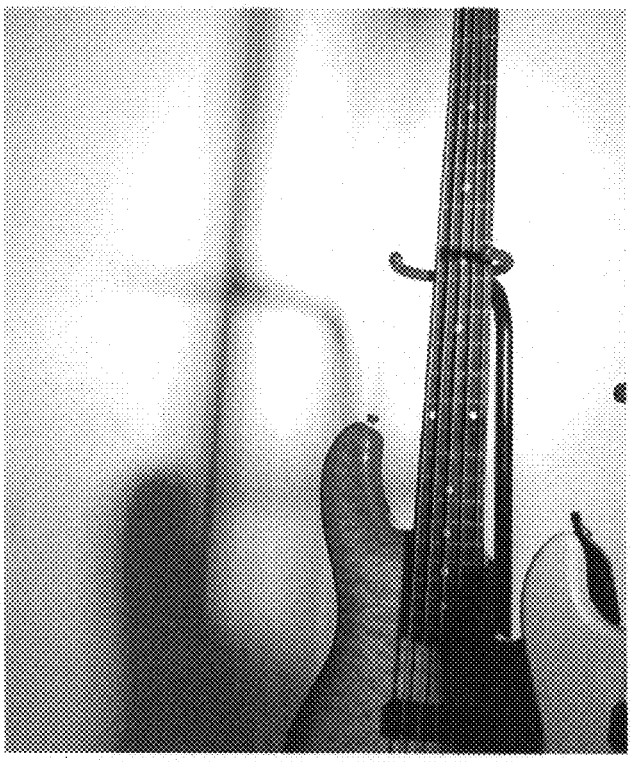

FIGS. 18A and 18B are a pair of reference photographs illustrating how secondary lenses assist in creating a virtual single source from the multiple LED arrays.

Figures 19A, 19B:
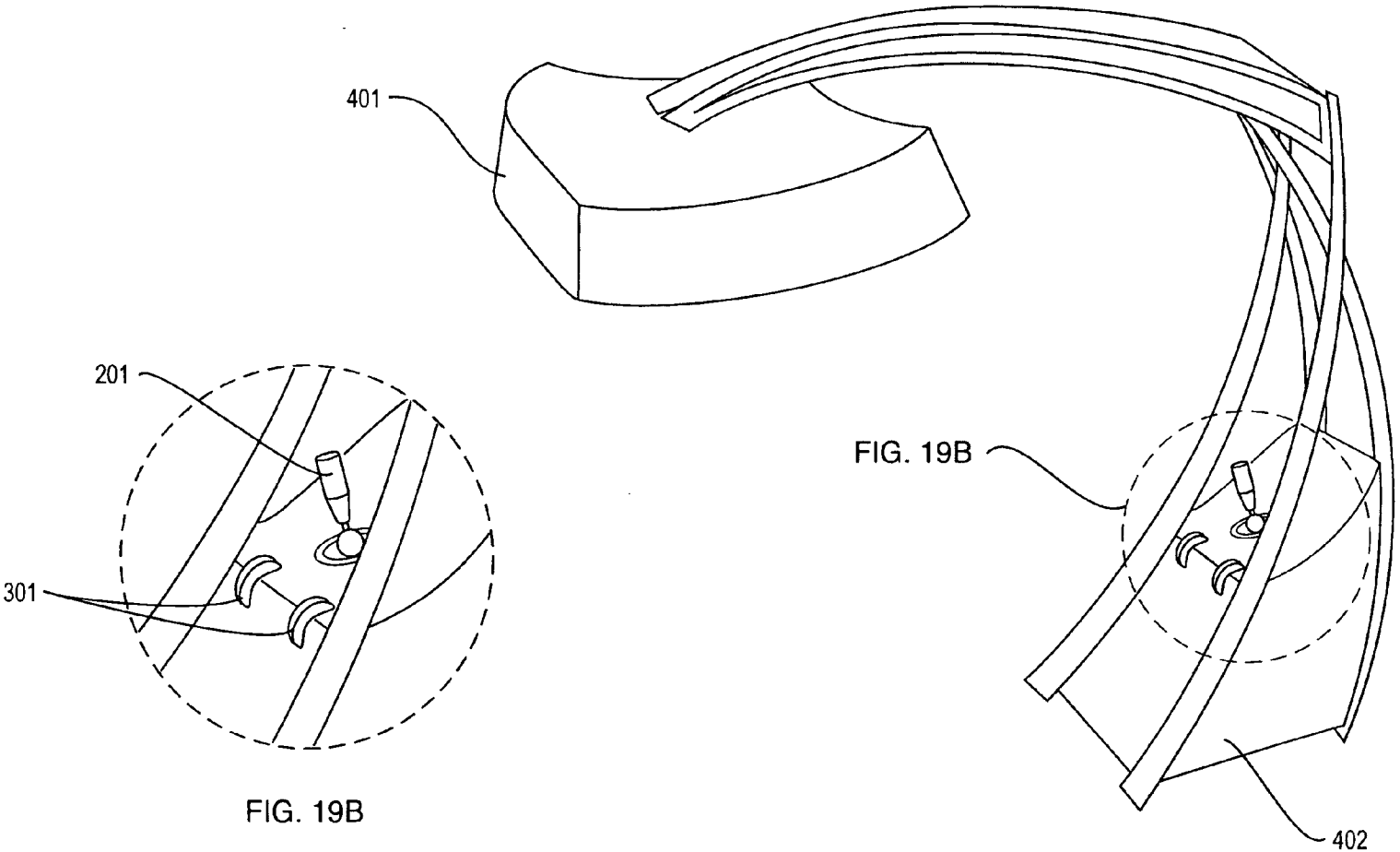

FIG. 19 is a line drawing of a desk lamp embodiment of the invention.

DETAILED DESCRIPTION OF THE INVENTION

A description of example embodiments of the invention follows.

FIGS. 1A and 1B are front and rear views of a first such example embodiment, as a compact, portable, high power light fixture 100. The light 100 includes a housing 102, Light Emitting Diode (LED) array 120, heat sink 101, and electronics control 108.

The heat sink 101 provides thermal management, and functions as the major structural component of the lamp 100, and mounting surface for the LED array 120.

Secondary lenses, labeled 106, cover the LED's in the array 120. In the illustrated embodiment, the secondary lenses are singular, such that a single secondary lens is associated with each LED in the array 120. However it should be understood that in other embodiments, a secondary lens 106 can cover multiple LEDs and deliver the same optical results discussed herein.

A top row of the array 120 consists of six "cool" white LEDs 104, and a bottom row consists of six "warm" white LEDs 105 in this embodiment. The LEDs 104, 105 are mounted on a Metal Core Printed Circuit Board (MCPCB) 130.

Array 120 may be intended to replace a single light bulb. Thus, array 120, as will be understood below, will be configured to appear as a Virtual Single Source (VSS). However, other arrangements of LEDs are possible, to provide multiple VSS in a single enclosure, each one in effect replacing a single light bulb.

The housing 121, and its sidewalls 102 are also attached to and supported by the heat sink 101. Housing 121 preferably also has sidewalls 102 which curtail the unblended beam edges for more consistent coloration of beam edge, and reflect this edge light back into the homogenous zone of the beam. As will be understood below, this aids with providing a virtual single light source function.

The electronics and control package 108 is split into two locations, one on the front of the lamp 100 under the lenses, and one on the back, nested into a channel between the heat sink portions. On the back view of FIG. 1B, the separate dimmer controls for the warm and cool arrays are visible, labeled 111 and 113 respectively.

FIG. 2A is an exploded schematic, in that the functional parts are diagrammatic and shown separate from their assembly. Heat sink 101 is for thermal management, and is also used as the structural mount for the majority of components and forms the major part of the total housing.

Thermally conductive mounts 103 provide physical mating of individual LEDs, or LEDs on a Metal Core Printed Circuit Board (MCPCB) 130 (or metal plate), to the heat sink 101, in the form of thermal tape, or thermal adhesive, or thermal grease or compound in combination with mechanical attachments such as screws or bolts or springs.

The LED array 120 comprises multiple LEDs 104, 105 of different types. A first subset of LEDs 104 are singular or plural high power, high CRI white LEDs of a particular CCT value, either connected on a single circuit or ganged circuits isolated in control from LEDs of any other CCT. In this particular embodiment, LEDs 104 are cool white, with a nominal CCT of 6,500° K. The second subset of LEDs 105, are singular or plural high power, high CRI white LEDs of a different CCT value, either connected on a single circuit or ganged circuits isolated in control from LEDs of any other CCT. In this particular embodiment, these are warm white, with a nominal CCT of 3,100° K.

Lenses 106 with a particular beam angle and efficiency, are integrally mounted to each one of the LEDs to control the resulting light beam quality, direction and intensity emitted from each light source 104, 105.

Optional diffusion element 107 is used to further soften the total output, assist in forming a virtual single source from a plurality of individual sources and alleviate multiple shadow defects in the beam output. The housing of this and like embodiments is built to accommodate easy attachment and removal of diffuser(s) 107 as needed.

Diffuser 107 may be formed of a translucent, transparent, or opaque material such as a plastic or glass. Diffuser 107 may take many other forms, such as territory lenses, fiberglass panels, sandblasted, etched or molded glass, diffractors or optical plastics, rice paper, polyester sheets or other light, beam modifiers. The function of diffuser 107 is described in more detail below. Thus, the use of the term "diffuser" herein to refer to element 107 should be understood as not limiting.

The dotted lines labeled 108 define the electronics and control package of this particular embodiment, which in other embodiments may be housed integrally with the lamp head or in separate aspects or locations of the total lamp, or in other embodiments, remotely. This is designated with the dotted line 108 for understanding the assembled schematic view in FIG. 2B. Main lamp switch 109 controls electric power to the lamp. In other embodiments, circuits for LEDs 104 and 105 could be individually switched. Likewise in other embodiments with a plurality of circuits, these could be individually or gang switched. A first constant current LED driver with dimming capabilities, 110, is used in conjunction with the circuit of 104. In other embodiments of the invention, large arrays of LEDs can be ganged and driven through an appropriate number of part 110 drivers. Outboard dimmer, 111, is of potentiometer type in this embodiment, but in other embodiments can be pulse width modulation type to suit the specific driver in use. A second constant current LED driver with dimming capabilities, 112, is used in conjunction with the LED circuit of 105. In other embodiments of the invention, large arrays of LEDs 105 can be ganged and driven through an appropriate number of part 112 drivers. Outboard dimmer, 113, is of potentiometer type in this embodiment, but in other embodiments can be pulse width modulation type to suit the specific driver in use.

FIG. 2B is a diagram of the above-described parts in a generalized assembled view, and corresponds to the accompanying drawings of the specific functional embodiment of FIG. 1A. This is just one possible embodiment of many, with variables of size, shape, number of components and drive controls. This embodiment utilizes simple manually responsive controls in the form of switches and rotary dimmer knobs. Other embodiments could include sliders, faders, as well as encoders that are linear, rotary or joystick in type and function. Other embodiments might also have dedicated direct lighting for task lighting, plus bounce or permanently diffused light sources for ambient lighting. Other embodiments might have lenses of varying (not singular) beam angle to suit specific criteria of beam spread and intensity. Other embodiments might have a three dimensional arrangement of individual sources, instead of the two dimensional array shown in FIG. 1A.

FIGS. 3A and 3B show a subset of example manually responsive controls, for embodiments currently called type 200 in the case of either joysticks or stick directional encoders, or type 300 in the case of rotary encoders with spring return, end stops or endless rotational functions.

As shown in FIG. 3A, type 200 is a stick directional encoder with thumb or hand control labeled 201. It offers two axes of movement, labeled 202 and 203 respectively, such as in joysticks on video games. As an example of how this can be employed in an embodiment of the invention, the front to back axis could control total lamp intensity and the left-right axis could control CCT value. For example, in one embodiment a user can push the joystick 201 on a desklamp from a region labeled "daylight" over to a region labeled "nighttime" as they desire a warmer light comparable to an incandescent. In a more sophisticated embodiment, multiple type 200 encoders or joysticks can be used to work with other control axes such as relative intensity of ambient vs. task light, or level of diffusion to control hard vs. soft light, or correspond to physical layout of a large space, for molding attention and serving specific uses within the space. In all embodiments, the manually responsive control is permitting user modification of light characteristics that can be directly perceived, for easy hand-eye coordinated, intuitive control.

In FIG. 3B, item 300 is a single axis encoder 301, with movement axis labeled 302. It could be used in a spring return-to-center part to "nudge" or fine tune a specific light parameter, or as a bank of parts 301 with end stops to function as a "micro" dimming board for a large or complex array. These embodiments and variables enable dynamic, manually responsive user control of lighting parameters in a way that encourages hand-eye coordinated action and resultant sense of responsive "feel". There are a plethora of control types that can be employed in various embodiments of the invention, and those in FIGS. 3A and 3B are used only to describe examples of control functions, and the method of the invention.

FIG. 4 is an exploded view of certain components of the light 100 taken from a rear perspective. Shown are the front housing and associated side walls 102 and diffuser 107. It is seen that heat sink 101 more particularly serves as the main structural support for both the housing 121 (including the sidewalls 102 thereof), as well as metal core printed circuit board 130. The frame 124, which may be disposed between fins of heat sink 101, serves as a support for dimmers 111 and 113.

FIG. 5 is a perspective view of a partial assembly showing how the printed circuit board 130 may be disposed directly on and supported by heat sink 101. A thermal epoxy 135 may be used to mount these printed middle core printed circuit board 130 to heat sink 101 thereby ensuring good thermal conductivity between the same. In this view, the individual lamp elements have associated therewith and installed thereon the secondary lenses 106 previously mentioned above and lens holders 146. Portions or control electronics 108 are also visible in this view as mounted for example on or adjacent printed circuit board.

FIG. 6 is a more detailed view of printed circuit board 130 showing the first and second LEDs 104 and 105 in this view with the secondary lenses 106 and secondary lens holders 146 removed.

FIG. 7 is a representation of the CIE chromaticity diagram, showing blackbody or Plankian locus. This is one objective standard for determining white light emissions. Coordinates that track the blackbody locus exhibit white light comparable to ideal blackbody radiating sources. A light source whose emissions are in relative proximity to this curve is an indication of the ability of the source to provide true color rendering and unbiased white and neutral reproduction in technical settings. The line on the graph thus forms a definition for a white light source as generally used herein. In preferred embodiments the present invention uses emitters that are either on the line or close to it, to alleviate problems with poor color rendition.

FIG. 8B is a side view showing a mounting plane, the LED array 120, diffuser 107 and resulting beam angles. FIG. 8A, provided herewith for convenience, shows the relative top schematic view of the LED array.

FIG. 8A shows a schematic plan view of the secondary lenses for the light 100, with the LED emitters 104, 105 directly under the center of each lens 106. This permits tight packing of the emitter arrays, providing desirable overlapping beam characteristics that assist in creating the "Virtual Single Source" (VSS) from the multiple LEDs in the array 120. Of primary significance for light 100, and in general for a light creating blended CCTs (correlated color temperature) from white light LEDs, is the need to minimize color fringing and offset color shadows in the total beam.

Providing virtual single source functionality is desirable for a light 100 that uses multiple point sources 104, 105. With white light LED technology, having such multiple sources with varying color temperature, the creation of a virtual single source is essential. Without doing so, the off setting colored shadows end up making the light undesirable or in critical uses unusable. The optional diffuser panel 107 also assists with this.

In the diagram of FIG. 8B, it becomes desirable to determine a minimum distance, D, from the LED array 120 to the diffuser panel 107. This distance is preferably set to be the same as the point where the beam angles have a definitive overlap and can be considered contiguous. This fills the diffuser 107 without gaps and defines a depth between the front faces of the secondary lenses 106 and a diffuser 107. More particularly, in the illustrated embodiment, a normal beam angle is provided at 25° by the collimator secondary lenses 106 for each beam.

As a point of reference, at this beam angle and a spacing between LEDs of approximately 17 millimeters, there will be an approximate 50% overlap of beams within 2½ inches of the mounting plane of the LED array. However it should be understood that this particular set of distances and resulting beam overlap is highlight dependent on the specific geometry chosen for the array, the optical features of the lenses and LEDs used, and other design parameters. Empirical findings have shown that at a distance of approximately 8 times the 50% beam overlap distance, the lighting unit 100 can exhibit beam characteristics of a virtual single source. This becomes very desirable as will be understood shortly, for a light source using multiple point sources to generate a sufficient quantity and quality of illumination.

The diagrams in FIGS. 8A and 8B particularly show the effective beam circle at the front of the secondary lens of 0.50757" (12.9 mm). This can be used to generate a table of beam diameters at varying distances from the light 100, through the use of trigonometry.

Assuming a fixed offset distance between lens centers of 0.66929" (17 mm), which also includes a small gap for repeatable manufacturing. This fixed offset distance is a critical dimension for determining the proportion of the total beam from each element of the array that will be combined with adjoining beams to form a virtual single source.

FIG. 9 illustrates these projected beam circles, as calculated with trigonometry. The distance to subject must compensate for diffraction caused by the lens. For a geometric beam angle of 25° to pass through a front lens diameter of 0.50757" (12.9 mm), the straight sides of the beam extend past the physical plane of the LEDs 104, 105 and lens housing 121. This fixed distance, shown on the diagram as r, is factored into calculations as a way to eliminate the effect of diffraction and create usable trigonometric dimension. It is added to every subject distance prior to calculating final beam diameter. As distance to subject increases, the significance of this factor decreases. Using the formula for determining the unknown leg of a right triangle yields the following example:

$$d1=2\ ((S1+r)*\tan(b*½))$$

if S1=10 inches . . .

$$d1=2((10+0.60211)*\tan(12.5))$$

$$d1=2(10.60211*0.2217)$$

$$d1=2(2.35)=4.7$$

FIG. 10A illustrates the result with a fixed offset distance, k, between two lens centers of 0.66929" (17 mm). This is the primary determining factor in controlling how much of the projected beam is shared, and how much is acting as a fringe of light without shared characteristics such as combined CCT. As the distance from light to subject increases, the beam diameter increases (shown as d1 and d2) but the small offset distance remains constant (shown as k). Thus, within a fairly short distance, the offset fringe light becomes a very small proportion of the total emissions, resulting in a virtual single source.

In reality, beam edges "feather" off as shown in the Cartesian output intensity plot of FIG. 10B of the lenses in use, with comparable LEDs. Therefore, all of the diagrams shown here are presenting a "worst case" scenario, that is ameliorated by the feathering of actual beams in use.

FIG. 11A illustrates a projection of 25° beams at distance of 1⅛" from the emitter backplane. Beams are contiguous at this minimum distance, enabling placement of diffuser 107 without beam gaps. Use of the optional diffuser 107 enables blending of color temperature at shorter distances. This illustration relates specifically to the use of optional diffuser panels and is shown to explain how the critical dimension of distance to diffuser 107 is determined. It is located at the distance where the beams become contiguous.

FIG. 11B illustrates a rectangle, of 1 15/16" by 4", that represents the diffuser slot area at distance of 1⅛" from emitter backplane. The diagram superimposes the projected beam circles at this distance over the hexagonal lens housings 106, showing overlapping, contiguous coverage of beams upon optional diffuser when in use. Since the diffuser 107 becomes the radiating source, the initial elimination of gaps from the LED array is optimum for creating a virtual single source (VSS) at working distances from the light 108.

The sharply defined beam circles in FIGS. 12 through 14 are for the purpose of illustration only. Drop off of illumination is not abrupt, but more gradually "feathers" off to zero intensity. See the lens intensity plot for more accurate portrayal of beam characteristics.

Also, in the black and white diagrams of FIGS. 12 through 14, all "cool" white CCT beams are shown as solid lines, and all "warm" white CCT beams are shown as dashed lines.

FIG. 12 is a black and white projection of 25° beams at minimum recommended distance of 18" with no diffusing elements 107 in place. Virtual Single Source begins to be functional. Areas of lower intensity still blend color temperature, except at extreme edges of array where color fringing is evident. Solid line circles represent "cool" white CCT beams, dashed line represents "warm" white CCT beams. In a color illustration (below), it is clear what parts of the total illumination are exhibiting color fringing, as well as how intensity varies, with central area shared by all beam circles exhibiting optimal evenness of both CCT and intensity.

FIG. 13 is a similar projection of 25° beams at distance of 24" with no diffusing elements 107 in place. Virtual single source is functional. Center area of virtual single source is larger than typical human head, making this functional for a single subject close-up shot. Areas defined exclusively by solid beam circles will exhibit "cool" CCT color fringing, whereas areas defined exclusively by dashed line circles will exhibit "warm" CCT color fringing. At this distance, color fringing is beginning to lose significance relative to total area of light.

FIG. 14 is a projection of 25° beams at recommended distance of 36" with no diffusing elements in place. Virtual single source is predominant, with only slight edge deficiencies, ameliorated by the practical reality of soft beam edges. The central field with even intensity and CCT is approximately 13" w by 15" h which is more than adequate for a medium close up of a single human subject. The regions to the sides of the central area are also fairly well blended in CCT but drop off in intensity in a way similar to standard incandescent lights. At greater distances from light 100, the virtual single source effect increases, and the regions of color fringing decrease proportionally.

FIGS. 15 through 17 are similar projections but using color instead to illustrate the fringing effects.

FIG. 15 is a color projection of 25° beams at minimum recommended distance of 18" with no diffusing elements 107 in place. Virtual single source begins to be functional. Areas of lower intensity still blend color temperature but lose intensity, except at extreme edges of array where color fringing is evident. From the color illustration, it is clear what parts of the total illumination are exhibiting color fringing, as well as how intensity varies, with central area shared by all beam circles exhibiting optimal evenness of both CCT and intensity.

FIG. 16 is a color projection of 25° beams at distance of 24" with no diffusing elements in place. Virtual single source is functional. Center area of virtual single source is larger than typical human head, making this functional for a single subject close-up shot. Areas defined exclusively by solid beam circles will exhibit "cool" CCT color fringing, whereas areas defined exclusively by dashed line circles will exhibit "warm" CCT color fringing. At this distance, color fringing is beginning to lose significance relative to total area of light.

FIG. 17 is a color projection of 25° beams at recommended distance of 36" with no diffusing elements 107 in place. Virtual single source is predominant, with only slight edge deficiencies, ameliorated by the practical reality of soft beam edges. The central field with even intensity and CCT is approximately 13" w by 15" h which is more than adequate for a medium close up of a single human subject. The regions to the sides of the central area are also fairly well blended in CCT but drop off in intensity in a way similar to standard incandescent lights. At greater distances from light, the virtual single source effect increases, and the regions of color fringing decrease proportionally.

The reference photos of FIGS. 18A and 18B show the effect of secondary lenses on shadow quality, and how the use of secondary lenses assist in creating a virtual single source from multiple LED arrays.

FIG. 18A shows a highly unnatural shadow quality resulting from an array of warm and cold LEDs without the secondary lenses 106 being installed. Note that multiple, competing shadows of objects are projected onto the white foam core background.

FIG. 18B is a photograph of the exact same view with the secondary lenses 106 installed on the LED array. In this view, the light is blended into a virtual single source. Shadow quality projected onto the white foam core background is significantly more natural and less distracting. Optional diffusing elements can increase this effect.

FIG. 19 is a line drawing of one design for an alternate desk lamp embodiment. The lamp head, labeled 401, contains multiple arrays of warm and cool white LEDs with secondary lenses and accommodations for diffusing elements. Each array can be considered a VSS to replace a corresponding single light source. In various embodiments of this invention as a desk lamp, the heat sinks could support either a single LED and secondary lens, or multiple LED and lens packages, with all heat sinks attached to the rest of the structure of the lamp. The electronics and control package, labeled 402, is at the base of the lamp in this embodiment. In other embodiments it could be in other locations within the lamp, or split into more than one housing, or housed separately from the desk lamp structure. An enlarged detail drawing of the user controls shows a joystick, labeled 201, and two spring-return encoders, labeled 301. These are of the type described in FIG. 3 above. The left-right axis of the joystick in this instance would enable users to make the white light warmer or cooler in CCT. The front-back axis would enable users to increase or decrease light intensity. The left and right spring-return encoders can enable users to make fine adjustments to warm and cool light output, after rough adjustment is made with the joystick. In other embodiments of a desk lamp, these three user controls could be replaced by other analog or digital positioning or encoding devices that offer manual responsiveness to the user, including dimmers of various kinds.

It should be understood that the lamp 100 can be used in various applications such as a room fixture, desk lamp, movie light, photographic light, cinematographic light, or in other applications.

While this invention has been particularly shown and described with references to example embodiments thereof, it will be understood by those skilled in the art that various changes in form and details may be made therein without departing from the scope of the invention encompassed by the appended claims.

Addendum

Pertinent Technical Issues of Lighting

Within the arts of photography and cinematography, there exist standard practices and means to control lighting parameters such directionality, quality, intensity, color temperature and beam characteristics. Directionality refers to the characteristic of light to come from a specific source and direction. Directionality is controlled through the type of source and its physical relation to the subject. Degree of directionality is also controlled, with non-directional ambient light being of a type that has no discernible single source. Quality typically refers to the control of "hard" and "soft" light. The extreme of hard light being a single point source, casting shadows that have a defined and specific edge, such as the light of the noon sun on a clear day. The extreme of soft source being a boundless surface area of diffused emission, casting little shadow or shadows with softly gradated edges, such as the light on a heavily overcast day. Quality is controlled through the type of source and through means such as reflectors and diffusing elements. Intensity is an objective measure of light at the source or subject, and is controlled by selection of lamp type and power, and distance to subject. There is a direct correlation between degree of directionality and quality. Color temperature is discussed separately, below. Beam characteristics refer to the pattern of projected light and include evenness, spread, shape, and note potential defects such as color fringing or color casts.

Within the areas of lighting design and general lighting there are comparable terms, methods and means of control of lighting parameters and characteristics. Unlike the case with cinematography, there is less user need for temporary lighting control, and means and methods are more typically fixed or permanent in nature. Parameters may be measured differently or with different units as standard. But, as with photographic methods, these general parameters, characteristics and methods of control are widely accepted and taught in similar fashion around the world at schools, universities and through professional training.

Regarding Color Temperature—Continuous spectrum output sources have a measurable color temperature, expressed in degrees Kelvin, which indicates the predominant wavelengths of emitted light, whether tending towards blue or amber, with the total output spread across all wavelengths in a smooth curve. Common incandescent bulbs have a low color temperature in the range of 2600 to 2900° K. which is "amber" or "warm", and tungsten/halogen/quartz lights are in the range of 3000 to 3200° K. and are advertised as "cleaner" because they are bluer. Sunlight is approximately 5000 to 5600° K. Skylight is usually at or above 8000° K., the bluer color noticeable in the shadows of white snow on a clear day. In practical usage, color temperature meters read this directly, and are a standard means in the photographic industries of assessing color temperature and employing technical means to control it.

People have an accepted bias towards higher color temperature light during day hours, and lower color temperature artificial sources at night. Artificial sources such as fire, candles and lanterns have a low color temperature. Incandescent sources in use for a century are also relatively warm. Office workers may appreciate a "daylight" fluorescent lamp because it more closely matches the higher color temperature light coming through a window, whereas a "warm" fluorescent might seem orange and off-putting. A person reading at night might reject a standard LED desk lamp because it projects very blue light. The cool color is at odds with a collective, historical, perceptual bias for warm light at night. Manufacturers have gone to great lengths to provide both compact fluorescents and LEDs with lower color temperature, to be acceptable as substitutes for incandescent bulbs.

Lights with discontinuous spectral output, such as fluorescents, sodium vapor lights and white LEDs, do not have a true color temperature and instead are given a Correlated Color Temperature (CCT) to express the perceptual and instrumental readings of predominant wavelengths on the amber to blue light axis, and thus indicate (in combination with the color rendering index or CRI) how well the source will match a blackbody radiator of a specific, true color temperature reading. Thus, the references within this document are to CCT, and not true color temperature.

CCT is intrinsic to the lamp or bulbs and sources within the lamp, and is controlled through type of lamp, with each lamp having a specific or controllable CCT. Additionally, it is modified through the use of gels or filters on the lamp that are manufactured to provide precise control of spectral distribution in exact and repeatable increments.

A discontinuous spectrum light source can provide white light with close to full spectral output across the wavelengths of visible light, thus achieving high CRI (color rendering index). High CRI (≧80) is essential for applications where color rendering or critical viewing is important to the user. Since few, if any, sources of light can radiate a completely smooth spectral output of visible white wavelengths, it is common to use the term CCT for all sources, with the CRI used as the indicator of how close or far the source is from a theoretical blackbody radiator in delivering completely smooth radiation of visible light wavelengths. The commonly used objective measure of this can be seen in the CIE 1931 chromaticity space (FIG. 4), which is typically illustrated with a curved line defined by coordinates that describe the arc of theoretical blackbody radiators through the range of color temperatures (known as the Plankian Locus or blackbody locus).

The testing and assignment of CRI is quantitative and commonly measures 8 samples which are viewed and analyzed under a reference source with known CRI approaching 100 (highest value), and then subsequently viewed and analyzed under the source being tested. The fidelity of color rendering of the samples is assessed, assigned a numeric value, repeated, averaged and reduced to a single CRI value that indicates how closely the color rendering of the tested source matches that of the reference standard. Newer methods use 14 test samples, with the 6 additional samples having higher saturation. As an example, the sodium vapor lights used for streetlights have a CRI around 20, common fluorescents have a CRI around 50, modern compact fluorescents offering better color viewing have a CRI in the 80's, while fluorescent tubes and HMI's designed for photographic use have a CRI in the 90's and tungsten/halogen lights and common incandescents have a CRI close to 100 (and are thus the only sources commonly referred to in the photographic industries as having a "true" color temperature and not a CCT). A 2004 study conducted by the National Lighting Product Information Program at Rensselaer showed that CRI was considered the most useful color criteria for light sources, with CCT a close second.

What is claimed is:

1. A lamp comprising:

at least two groups of white light emitting diode (LED) sources, with the LED sources in a given group having a light output of a predetermined color temperature distinct from a color temperature of the LED sources in the other groups;

at least one secondary lens arranged to alter optical emissions of the groups of LED sources;

a heat sink;

a substrate, on which the plurality of LED sources are mounted, the substrate being in thermal contact with the heat sink, and mechanically supported by the heat sink;

a housing, disposed so as to structurally supported by the heat sink; and a diffuser, disposed within the housing, and held in a determined location with respect to the LED sources by the housing.

2. The lamp of claim 1 additionally comprising:

a user operable control, for variably blending light output by the groups of LED sources.

3. The lamp of claim 1 wherein the lamp provides a relatively high color rendering index (CRI).

4. The lamp of claim 1 wherein the emission of the lamp is in close proximity to a blackbody locus curve of a CIE chromaticity graph.

5. The lamp of claim 2 additionally comprising:

a preset indication for the user operable control.

6. The lamp of claim 5 additionally comprising:

a memory for storing a setting of the user operable control.

7. The lamp of claim 6, wherein the user operable control contains provides numeric indicators for each of several variables, so that a specific setting for the user operable controls can be manually recreated.

8. The lamp of claim 1 used as one of a room fixture, desk lamp, movie light, photographic light, or cinematographic light.

9. The lamp of claim 1 wherein the substrate is a metal core printed circuit board, additionally comprising:

thermally conductive material disposed between the substrate and the heat sink.

10. A lamp comprising:

at least two groups of white light emitting diode (LED) sources, each one of multiple LED sources in a given group having a light output of a predetermined color temperature distinct from a color temperature of the LED sources in the other groups;

at least one secondary lens, arranges to alter optical emission of the two groups of LED sources;

a substrate, on which the plurality of LED sources are mounted in predetermined positions, such that light beams emitted from the LED sources overlap to provide contiguous beams at a virtual single light source plane; and a diffuser, disposed at a predetermined position within the virtual single light source plane.

11. The lamp of claim 10 additionally comprising:

a housing, disposed to structurally support the diffuser.

12. The lamp of claim 11 wherein the housing further comprises reflective sidewalls.

13. The lamp of claim 11 additionally comprising:

a heat sink, disposed in thermal communication with the substrate, and to mechanically support the substrate, and to thus fix a position of the LEDs with respect to the virtual single light source plane.

14. The lamp of claim 11 additionally comprising:

a user operable control, for variably blending light output by the groups of LED sources.

15. The lamp of claim 11 wherein the lamp provides a relatively high color rendering index (CRI).

16. The lamp of claim 11 wherein light emission of the lamp is in close proximity to a blackbody locus curve of a CIE chromaticity graph.

17. The lamp of claim 14 additionally comprising:

a preset indication for the user operable control.

18. The lamp of claim 14, wherein the user operable control contains provides numeric indicators for each of several variables, so that a specific setting for the user operable controls can be manually recreated.

19. The lamp of claim 11 used as one of a room fixture, desk lamp, movie light, photographic light, or cinematographic light.

20. The lamp of claim 13 wherein the substrate is a metal core printed circuit board and additionally comprising:

thermally conductive material disposed between the substrate and the heat sink.

21. The lamp of claim 11 additionally comprising:

means for control of color fringing through diffraction, reflection or masking of exterior beam edges of the two groups of white LED sources.

22. The lamp of claim 11 wherein the secondary lens is one of a plurality of singular lenses, each associated with a corresponding white LED source.

23. The lamp of claim 11 wherein the secondary lens is associated with a plurality of associated white LED sources.

24. The lamp of claim 11 wherein the lamp provides a virtual single source.

25. The lamp of claim 11 wherein the lamp provides multiple virtual single sources.

26. The lamp of claim 25 wherein the lamp lamp forms one of a plurality of like lamps, and wherein the resulting virtual single sources are not co-planar.

* * * * *

UNITED STATES PATENT AND TRADEMARK OFFICE

CERTIFICATE OF CORRECTION

PATENT NO. : 7,845,824 B2
APPLICATION NO. : 12/229903
DATED : December 7, 2010
INVENTOR(S) : Thomas Robotham It is certified that error appears in the above-identified patent and that said Letters Patent is hereby corrected as shown below:

In Claim 26, Column 22, line 50, please delete the second occurrence of the word "lamp".

Signed and Sealed this
Nineteenth Day of April, 2011

David J. Kappos

David J. Kappos
*Director of the United States Patent and Trademark Office*